US007185449B2

(12) United States Patent
Kime

(10) Patent No.: US 7,185,449 B2
(45) Date of Patent: Mar. 6, 2007

(54) SYSTEM FOR CONTROLLING THE HYDRAULIC ACTUATED COMPONENTS OF A TRUCK

(76) Inventor: James A. Kime, 3987 Riverview Dr., Columbus, OH (US) 43221

( * ) Notice: Subject to any disclaimer, the term of this patent is extended or adjusted under 35 U.S.C. 154(b) by 486 days.

(21) Appl. No.: 10/801,256

(22) Filed: Mar. 16, 2004

(65) Prior Publication Data

US 2005/0204587 A1 Sep. 22, 2005

(51) Int. Cl.
*E01H 5/04* (2006.01)

(52) U.S. Cl. ..... 37/234; 37/382; 37/414; 701/50

(58) Field of Classification Search ..... 37/234, 37/341, 348, 382, 414, 415, 416; 701/50
See application file for complete search history.

(56) References Cited

U.S. PATENT DOCUMENTS 3,754,394 A * 8/1973 Morrison ..... 60/484
4,773,494 A * 9/1988 Anderson ..... 180/6.48
6,290,474 B1 * 9/2001 Bavendiek et al. ..... 417/423.3

* cited by examiner

*Primary Examiner*—Thomas B. Will
*Assistant Examiner*—Alicia Torres
(74) *Attorney, Agent, or Firm*—Mueller Smith & Matto

(57) ABSTRACT

A system for controlling the hydraulically actuated components, including snow-ice control components carried by a truck. The system employs a hermetically secure composite housing mounted externally of the truck cab on the truck frame which retains a unique hydraulic reservoir in combination with a manifold supporting a plurality of solenoid actuated hydraulic valves and an associated electronic drive circuitry including a slave controller having a bidirectional data transmission port. That port communicates through a single bidirectional transmission bus with a master controller retained within an operator interface control console mounted in the truck cab. That control console also will contain a slave interface controller, as well as a slave datalog and communications controller.

48 Claims, 13 Drawing Sheets

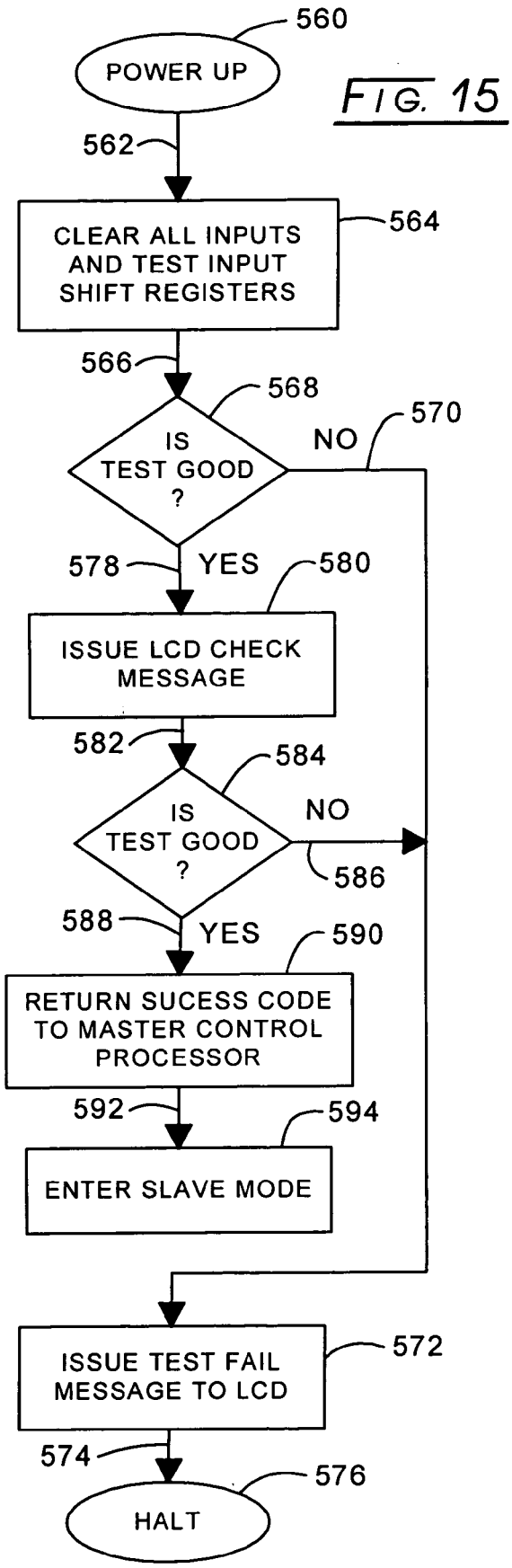
FIG. 15
FIG. 16
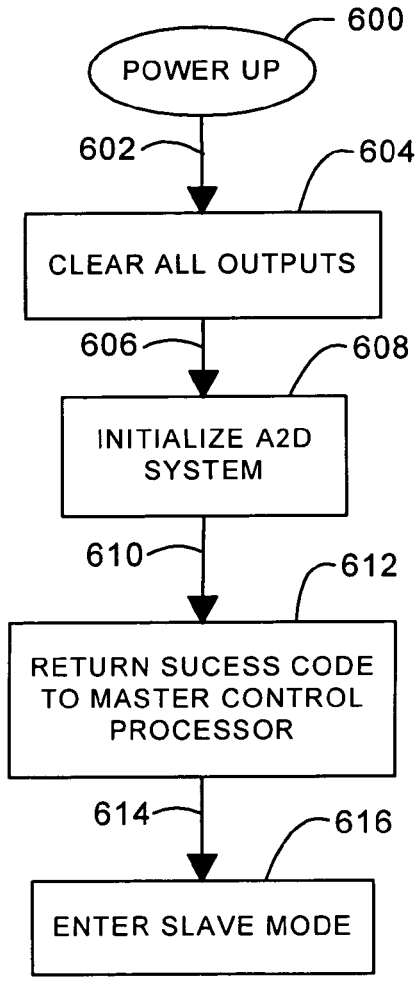

SYSTEM FOR CONTROLLING THE HYDRAULIC ACTUATED COMPONENTS OF A TRUCK

CROSS-REFERENCE TO RELATED APPLICATIONS

STATEMENT REGARDING FEDERALLY SPONSORED RESEARCH

Not applicable.

BACKGROUND OF THE INVENTION

Snow and ice control over primary, high speed highways such as interstate systems typically is carried out by governmental authorities with the use of dump trucks which are quite robust, for example, typically exceeding 28,000 pounds gross vehicle weight (GVW). This robust size requires operators with commercial drivers license qualifications. In general, the trucks are somewhat similar in general layout of the cab and the like from manufacturer to manufacturer in view of the anticipated primary highway related endeavors. These trucks are seasonally modified by the addition of snow-ice treatment components. Such components will include forwardly mounted plows, wing plows, scrapper plows and rearwardly-mounted mechanisms for broadcasting materials such as salt or brine containing salt. The classic configuration for the latter broadcasting mechanisms includes a feed auger extending along the back edge of the dump bed of the truck. This hydraulically driven auger effects a metered movement of material from the bed of the truck into a rotating spreader disk or "spinner" which functions to broadcast the salt across the pavement being treated. To maneuver the salt-based material into the auger, the dump bed of the truck typically has been progressively elevated as the truck moves along the highway to be treated. Thus, when into a given run, the dump bed will be elevated, dangerously raising the center of gravity of the truck under inclement driving conditions. Generally, the snow-ice control mechanisms mounted on these trucks perform in conjunction with a hydraulic circuit which, for example, will carry out all season functions such as hoisting a dump bed and the like. The hydraulic systems very often are controlled with electronics which are mounted within the truck cab and have electrical feeder lines extending to feedback sensors mounted about the frame of the truck. Many such sensors and feedback lines along with associated couplers are seasonally removed and even though of high quality, are prone to corrosive failure in view of the rigid environment the trucks are exposed to. As a consequence, their replacement often is on a yearly basis.

An initial improvement in the controlled deposition of salt materials and the like has been achieved through the utilization of microprocessor driven controls over the hydraulics employed with the modified dump trucks. See Kime, et al., U.S. Pat. No. Re. 33,835, entitled, "Hydraulic System for Use With Snow-Ice Removal Vehicles", reissued Mar. 3, 1992. This Kime, et al. patent describes a microprocessor-driven hydraulic system for such trucks with a provision for digital hydraulic valving control which is responsive to the instantaneous speed of the truck. With the hydraulic system, improved controls over the extent of deposition of snow-ice materials is achieved. Of further importance, the binary form of digital valving removes a requirement for the vulnerable feedback lines and associated sensors. This patent is expressively incorporated herein by reference.

Investigations into techniques for controlling snow-ice pavement envelopment have recognized the importance of salt in the form of salt brine in breaking the bond between ice and the underlying pavement. Without a disruption of that bond, little improvement to highway traction will be achieved. For example, a plow merely will scrape off the snow and ice to the extent possible, only to leave a slippery coating which may be more dangerous to the motorist than the pre-plowed road conditions.

When salt has been simply broadcast over an ice laden pavement from a typical spinner, it will have failed to form a brine of sufficient salt concentration to break the ice-pavement bond. The result is usually an ice coated pavement, in turn, coated with a highly dilute brine solution developed by too little salt, which will have melted an insufficient amount of ice for traction purposes. This condition is encountered often where granular salt material contains a substantial amount of "fines". Fines are very small salt particles typically generated in the course of transporting, stacking, and storing road maintenance salt in dome-shaped warehouses and the like.

Road snow-ice control studies have revealed that the activity of ice melting serving to break the noted ice-pavement bond is one of creating a salt-water brine of adequate concentration. In general, an adequate salt concentration using conventional dispersion methods requires the distribution of an unacceptable quantity of salt on the pavement. Some investigators have employed a saturated brine as the normal treatment modality by simply pouring it on the ice covered highway surface from a lateral nozzle containing spray bar mounted behind a truck. A result has been that the thus-deposited brine concentration essentially immediately dilutes to ineffectiveness at the ice surface.

Attempting to remove ice from pavement by dissolving the entire amount present over the entire expanse of pavement to be treated is considered not to be acceptable from an economical as well as environmental standpoint. For example, a one mile, 12 foot wide highway lane with a one-fourth inch thickness of ice over it should require approximately 4 tons of salt material to make a 10% brine solution and create bare pavement at 20° F. Technical considerations for developing a salt brine effective to achieve adequate control are described, for example, by D. W. Kaufman in "Sodium Chloride: The Production and Properties of Salt and Brine", Monograph Series 145 (Amer. Chem. Soc., 1960).

The spreading of a combination of liquid salt brine and granular salt has been considered beneficial. In this regard, the granular salt may function to maintain a desired concentration of brine for attacking the ice-pavement bond and salt fines are more controlled by dissolution in the mix. The problem of excessive salt requirements remains, however, as well as difficulties in mixing a highly corrosive brine with particulate salt. Typically, nozzle injection of the brine is the procedure employed. However, attempts have been made to achieve the mix by resorting to the simple expedient of adding concentrated brine over the salt load in a dump bed. This approach is effective to an extent. However, as the brine passes through the granular salt material, it dissolves the granular salt such that the salt will not remain in solution and will re-crystallize causing bridging phenomena and the like inhibiting its movement into a distribution auger.

The techniques of deposition of salts in a properly distributed manner upon highway surfaces also has been the subject of investigation. Particularly where bare pavement initially is encountered, snow-ice material deployed with conventional equipment will remain on the highway surface at the time of deposition only where the depositing vehicles are traveling at dangerously slow speeds, for example, about 15 m.p.h. Above those slow speeds, the material essentially is lost to the roadside and that material located within the wheel tracks of traffic will be disbursed. Observation of materials attempted to be deposited at higher speeds shows the granular material bouncing forwardly, upwardly, and being broadcast over the pavement edges such that deposition at the higher speeds is ineffective as well as dangerous and potentially damaging to approaching vehicles. The latter damage sometimes is referred to as "collateral damage" or damage to coincident traffic. However, the broadcasting trucks themselves constitute a serious hazard when traveling, for example, at 15 m.p.h., on dry pavement, which simultaneously is accommodating vehicles traveling, for example, at 65 m.p.h. The danger so posed has been considered to preclude the highly desirable procedure of depositing the salt material on dry pavement just before the onslaught of snow-ice conditions.

Kime, et al. in U.S. Pat. No. 5,318,226 entitled "Deposition of Snow-Ice Treatment Material From a Vehicle With Controlled Scatter", issued Jun. 7, 1994 (incorporated herein by reference) describes an effective technique and mechanism for controlling the scatter of the so-called granules at higher speed. With the method, the salt materials are propelled by an impeller from the treatment vehicle at a velocity commensurate with that of the vehicle itself and in a direction opposite that of the vehicle line of travel. The result is an effective suspension of the projected materials over the surface of pavement under conditions of substantially zero velocity with respect to or relative to the surface of deposition. Depending upon vehicle speed desired, material deposition may be provided in controlled widths ranging from narrow to wider bands.

A practical technique for generating a brine of sufficient concentration to break the ice-pavement bond is described in U.S. Pat. No. 5,988,535 entitled "Method and Apparatus for Depositing Snow-Ice Treatment Material on Pavement" by Kime, issued Nov. 23, 1999. With this technique, ejectors are employed to deposit a salt-brine mixture upon a highway as a relatively narrow, continuous and compact band of material. To achieve such narrow band material deposition at practical highway speeds of 40 m.p.h. or more, the salt-brine mixture is propelled from the treatment vehicle at a velocity commensurate with that of the vehicle itself and in a direction opposite that of the vehicle. Further, the material is downwardly directed at an acute angle with respect to the plane defined by the pavement. When the salt-brine narrow band is deposited at the superelevated side of a highway lane, the resultant concentrated brine from the band is observed to gravitationally migrate toward the opposite or downhill side of the treated lane to provide expanded ice clearance. The result is a highly effective snow-ice treatment procedure with efficient utilization of salt materials.

An improvement in the zero relative velocity broadcasting technique is described in U.S. Pat. No. 6,446,879 entitled "Method and Apparatus for Depositing Snow-Ice Treatment Material on Pavement" by Kime, issued Sep. 10, 2002, in which narrow band ejection of salt and brine is provided in a manner wherein it is encountered by the rear drive wheels of a dump truck.

Over the recent past, investigators have returned to the subject of pre-treating a bare or dry highway pavement before a weather event occurs otherwise generating ice/pavement bond conditions. Rather than attempting to deposit granular salt on a highway, brine is placed on the roadway in small, angularly downwardly directed streams spaced about eight to twelve inches apart and usually extending across a width of one driving lane. The total application rate usually is thirty to sixty gallons of salt brine per lane mile. Where clear weather permits, the resultant brine strips will dry leaving a tenaciously bonded strip of fine salt along the pavement somewhat emulating paint. With continued dry weather, these fine crystalline strips will remain on the pavement for several days or more except for some deterioration along vehicle wheel track regions. When snow conditions then commence, the resultant moisture will activate the strips to attack the very development of an ice/pavement bond condition. Rubber edged squeegee plows have been used to remove a resultant un-bonded slush from the pretreated highway.

Kime, in U.S. Pat. No. 7,108,196 entitled "Method and Apparatus for Depositing Snow-Ice Treatment Liquid on Pavement", issued Sep. 19, 2006, describes a brine pre-treatment method and apparatus wherein three streamer nozzles are employed, two of which are mounted laterally outwardly from the sides of the application truck and one is positioned between the rear wheels of the truck. Utilizing a vehicle speed responsive and accurate pump drive in conjunction with the streamer nozzle structures, liquid brine may be deposited at target volume levels per unit pavement mile outside of traffic wheel track zones so as to remain undisturbed pending the development of a weather event reactivating the brine. The outward streamer nozzles are employed to deposit liquid brine at the superelevated or near the crown portion of a highway lane. By positioning the streamer nozzles quite close to the pavement surface and aligning their axes in substantially parallel relationship with the plane defined by the pavement, very little overspray or splash otherwise occasioned by truck induced wind turbulence is encountered and a very high deposition efficiency is achieved. With the system, brine is deposited at relatively high highway speeds with little or no hindrance to coincident traffic.

The excellent effectiveness and attendant environmental and economic advantages of brine pre-treatment programs is significant. In general, governmental highway organizations consider that an initial application upon highways under snow-ice conditions, for example, on interstate highways, will be about 600 pounds of granular salt per mile. A pre-treatment of liquid brine at about 60 gallons per mile will evoke the use of a corresponding amount of salt from between about 100 and 125 pounds. Of particular economic interest, because the brine can be deposited well before an impending weather event, trucks and drivers can be utilized during normal working hours. In compliment with these economies, improvements have been made in techniques employed for forming the brine solutions prior to loading on the depositing trucks. See in this regard U.S. Pat. No. 6,736,153 by Kime, entitled "Brining System, Method and Apparatus", issued May 18, 2004.

While substantial technical advances have been witnessed by authorities responsible for snow-ice control over primary or interstate highways, municipal and township governments responsible for snow-ice treatment of secondary roads traditionally have employed smaller and more maneuverable trucks. Such trucks fall below the 28,000 pound GVW criteria. The trucks are seasonally retrofitted with forward plows, augers and spinners which for the slower speeds involved, have been manually controlled by operators. In general, providing these smaller vehicles with sophisticated, automated snow-ice control systems has been considered to be economically impractical. Such impracticality has been further evidenced by the restrictions posed by the more pronounced variations in cab layouts among the trucks mounts provided by various truck manufacturers. However, economic and environmental considerations now are changing the above-noted conventions for snow-ice control on secondary roadways. Significant economies are envisioned with accurate salt deposition and brining pre-treatment procedures. Notwithstanding the slower speeds involved, automated controls will be necessary to achieve such anticipated economies. However, a simplification of the installation of the automated systems is called for and when realized will have application not only to the smaller trucks but also to systems employed for treating primary highways.

BRIEF SUMMARY OF THE INVENTION

The present invention is addressed to a system for controlling the hydraulically actuated components of a truck. These components will include seasonally mounted snow-ice control devices such as plows, spinners, augers and the like. The system includes a unique hydraulic fluid reservoir which is combined in a hermetically secure composite housing with a manifold of electromagnetically actuated valves, a function of which is to provide control over the hydraulically actuated components. Also incorporated within this hermetically secure housing is a composite control assembly including a slave composite assembly controller and electronic components such as drivers and the like which are employed in controlling the actuation of the noted valves. The slave controller is further associated with a variety of sensing components such as a high pressure sensor, low pressure sensors, temperature sensors, plow position sensors, speed sensors and two-speed sensors and their associated signal treating networks employed for filtering or buffering debouncing and the like. All of these electronic components are protected by the hermetically secure nature of the composite housing.

The composite housing is mounted upon the truck frame at a convenient location which may be adjacent the truck cab.

Within the cab itself there is provided a control console carrying operator interfacing switches a display and an associated slave interface controller. Also locatable within the cab-mounted console is a master controller and a slave datalog and communications controller. Communication between the master controller and the three slave controllers is by a bidirectional data transmission assembly such that the cab is penetrated essentially by one bidirectional data transmission bus extending from the slave composite housing controller to a bidirectional data transmission port at the master controller. That port also communicates in serial bidirectional communication fashion with the noted slave operator interface controller and the slave datalog and communications controller. Preferably, communication between the master controller and the composite housing controller is with a robust Recommended Standard 485 (RS 485) multipoint, differential data transmission bus.

The size of the composite housing or assembly is maintained within practical limits by a unique design of the hydraulic fluid reservoir contained therein. With this design, the conventional reservoir requirements for a given hydraulic pump may be substantially reduced. Through utilization of an elongate fluid receiving chamber extending along the bottom surface of the reservoir between a fluid dispensing region and a fluid receiving region. A fluid return conduit having an input coupled in fluid flow transfer communication with hydraulic return conduiting extending from the truck-mounted components is configured having a return fluid outlet extending within the fluid receiving chamber at the fluid receiving region. Spaced from the fluid receiving region, the fluid dispensing region is coupled in fluid transfer relationship with the reservoir suction port. At the fluid receiving region, an outgasing transfer arrangement is positioned in the top of the fluid receiving chamber and this transfer region functions to transfer gas from fluid expressed from the return fluid outlet upwardly from the fluid receiving region into a portion of the reservoir which is disposed remotely from the noted suction port. The outgasing transfer region or portion may be configured simply as a small grouping of apertures extending through the top of the fluid receiving chamber.

To further protect the electronic components within the composite housing from environmental attack, a pressurizing filler breather cap is provided with the hydraulic fluid filler port located just above the fluid level of the unique fluid reservoir.

Other objects of the invention will, in part, be obvious and will, in part, appear hereinafter. The invention, accordingly, comprises the system possessing the construction, combination of elements and arrangement of parts which are exemplified in the following description.

For a fuller understanding of the nature and objects of the invention, reference should be had to the following detailed description taken in connection with the accompanying drawings.

BRIEF DESCRIPTION OF THE DRAWINGS

FIG. 15 is a flowchart illustrating a power-up of procedure associated with the operator interface controller shown in FIG. 9C;

FIG. 16 is a flowchart illustrating a power-up procedure for the composite controller shown in FIG. 9A;

DETAILED DESCRIPTION OF THE INVENTION

In the discourse to follow, the system and apparatus for controlling truck-mounted hydraulically actuated components is illustrated in connection with exemplary trucks having gross vehicle weights (GVW) less than 26,000 pounds. Because the system employs a truck frame-mounted hermetically secure reservoir and manifold composite assembly incorporating its own control assembly and associated slave composite assembly controller, communication to the truck cab operator interface and an associated master controller is by the advantageous expedient of using a bidirectional data transmission bus. Thus the system is readily installed in trucks with cabs of widely varying layout. Software employed with the multi-controller system is designed to accommodate the more elaborate hydraulic circuits of larger, principal highway traveling snow-ice control configured trucks. The system may be employed to control any of a wide variety of truck snow-ice control configurations both for depositing granular salt which may be wetted with brine and for depositing brine solutions alone.

Figure 1:
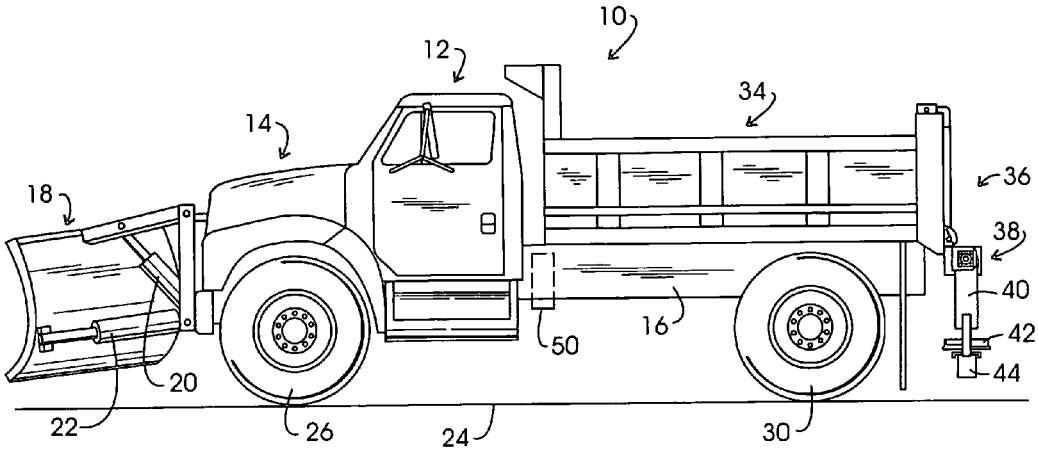
FIG. 1 is a side-elevational view of a truck mounted with snow-ice control apparatus and the hydraulic control system of the invention.

Referring to FIG. 1, a utility vehicle which may be employed with the seasonal duties of snow-ice removal as well as other truck-based endeavors not related to snow-ice control is revealed generally at 10. Configured as a dump truck, vehicle 10 includes a cab 12 and hood 14 which protects and provides access to an engine as well as a hydraulic pump driven by the engine (not shown). These components are mounted upon a frame, a portion of which is shown at 16. At the forward end of the vehicle 10 there is mounted a front snowplow represented generally at 18 which is elevationally maneuvered by up-down hydraulic cylinder assembly 20. Additionally, front plow 18 is laterally, angularly adjusted by a hydraulic cylinder assembly 22. Larger snow-ice control trucks typically will be additionally configured with a wing plow (not shown) which is mounted adjacent the right or left fender of vehicle 10 and which functions generally as an extension of the front plow 18, serving to push snow off a shoulder. Additionally not shown are scraper plows which are mounted beneath the frame 16 and which are hydraulically controlled.

Truck 10 is supported on the highway or roadway pavement surface 24 by front and rear wheels a left front wheel is shown at 26 and a rear dual wheel assembly is shown at 30. Truck 10 includes a support portion represented generally at 34 which is configured as a dump bed. In FIG. 1, the rearward portion of dump bed 34 incorporates a tailgate represented generally at 36. Below tailgate 36 there is mounted a granular salt maneuvering auger represented generally at 38 having a downwardly directed supply chute 40 below which is coupled a spinner assembly 42. Auger 38 is driven by a hydraulic motor controlled by the system of the invention and, similarly, spinner assembly 42 is driven by a hydraulic motor 44 also under the control of the instant system. Shown mounted interiorly of frame 16 is the earlier noted hermetically secure reservoir and manifold composite assembly as identified at 50.

Figure 2:
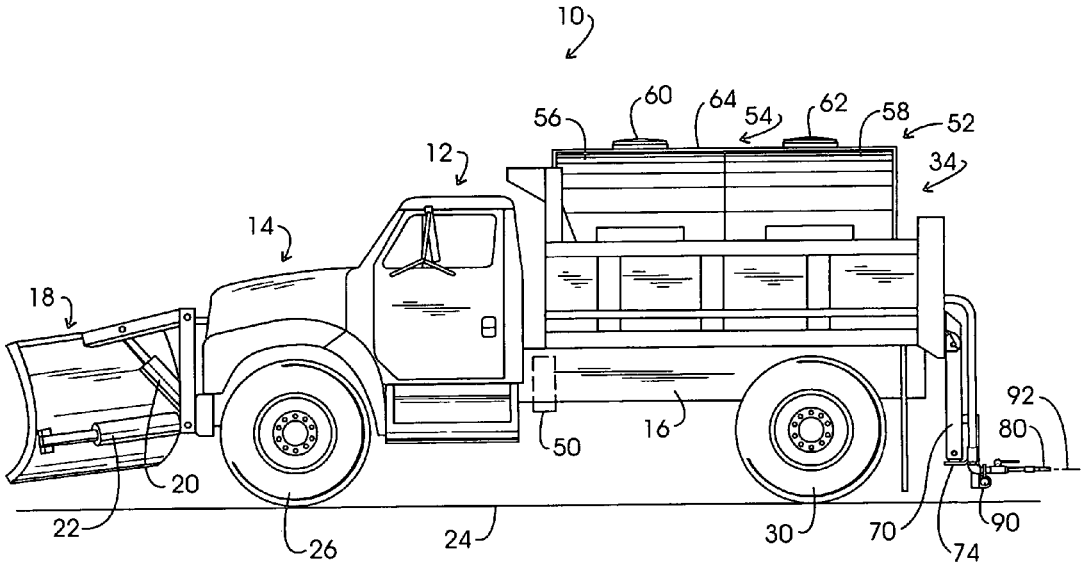
FIG. 2 is a side-elevational view of a truck outfitted with the apparatus and system of the invention and carrying snow-ice control pretreatment components.
Figure 3:
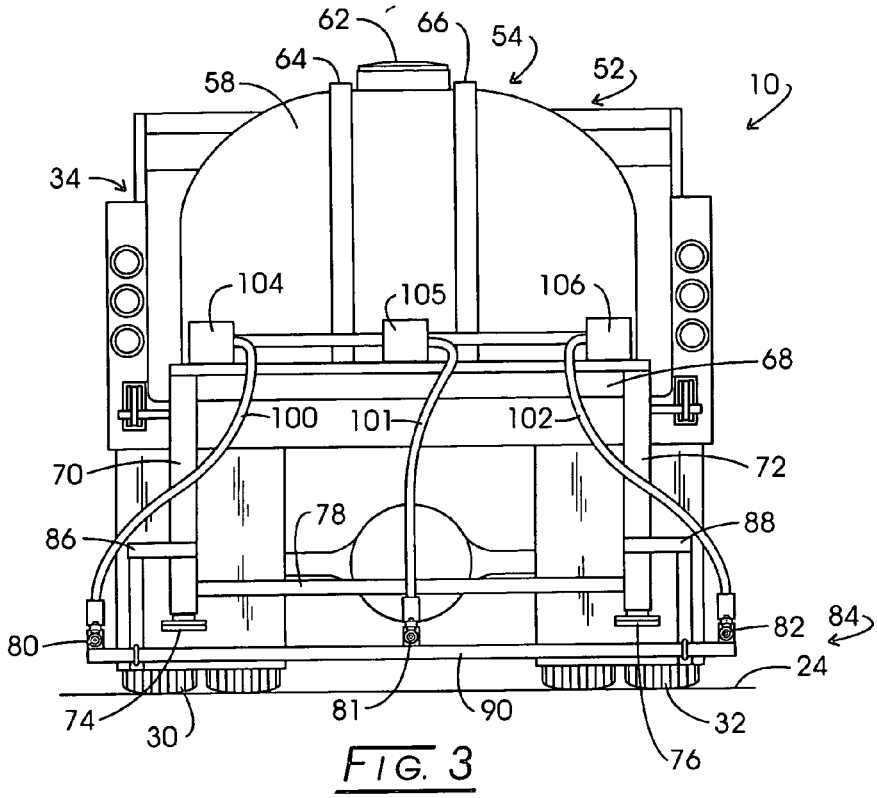
FIG. 3 is a rear-elevational view of the truck of FIG. 2.

Truck 10 can also be configured to distribute a snow-ice control liquid such as brine on the pavement 24. A variety of techniques are available for this purpose, one arrangement being shown in FIGS. 2 and 3. Looking to those figures, dump bed 34 is shown supporting a frame-mounted modular snow-ice control apparatus which is configured for carrying out a pretreatment procedure by depositing a snow-ice treatment liquid such as sodium chloride brine upon a dry pavement surface 24. Apparatus 52 is described in detail in U.S. Pat. No. 7,108,196 (supra). Apparatus 52 includes a tank assembly represented generally at 54. Assembly 54 is shown comprised of two polymeric tanks 56 and 58 which centrally are of generally elliptical cross-section with forwardly and rearwardly integrally formed support portions. Covered manways are shown respectively at 60 and 62 and the tanks are interconnected adjacent their bottom portions with one or more equalizing conduits, for example, having a diameter of about 3 inches. Such an equalization arrangement along with the design and a modular use of the tanks functions to avoid sloshing of the liquid within the tanks. Each of the tanks 56 and 58 may, for example, have a capacity of about 650 gallons and will be loaded with premixed brine. That brine may be premixed with the system described in the above-identified U.S. Pat. No. 6,736,153. While the tanks may be mounted directly on the floor of dump bed 34, the apparatus 54 may be configured in modular fashion mounted upon a frame which is supported from the floor of the dump bed 34. In this regard, the figures reveal two galvanized brackets 64 and 66 which are components of that frame. FIG. 3 reveals a rearward cross beam 68 of the frame along with left and right rigid steel standards 70 and 72 having respective foot components 74 and 76. A horizontal support 78 extends between standards 70 and 72. Feet 74 and 76 are extended when the modular control arrangement 52 is removed from dump bed 34 such that the frame supporting the apparatus will be positioned above pavement a dump bed floor height. Additional pivotal struts (not shown) complete this elevated on pavement support. FIG. 3 illustrates that the apparatus 52 includes a rearwardly directed left streamer nozzle 80; a rearwardly directed intermediate streamer nozzle 81; and a rearwardly directed right streamer nozzle 82. Nozzles 80–82 are supported upon a nozzle support represented generally at 84 and comprised of downwardly depending standards 70 and 72, galvanized brackets 86 and 88 and a lower disposed cross rod 90 which is seen to be located quite close to pavement surface 24. Note that it extends leftwardly outwardly from the left wheel assembly 30. In this regard, left streamer nozzle 80 is mounted at the left end of rod 90 and thus is positioned about six inches laterally outwardly and leftwardly from vehicle tracks represented by the wheel assembly 30. As shown in FIG. 2, the nozzle axis 92 of nozzle 80 is substantially parallel with the surface of pavement 24 and is arranged so as to be additionally parallel with the forward direction of travel of the vehicle 10. Experience with this form of mounting has shown that the nozzle axis as at 92 may be canted downwardly toward the pavement surface 24 by a very shallow angle. Note that cross rod 90 also extends laterally rightwardly and outwardly from rear wheel assembly 32 by about six inches. In similar fashion as left nozzle 80, right streamer nozzle 82 is rearwardly directed at its nozzle axis; (not shown) is substantially parallel with the surface of pavement 24 as well as the forward directional movement of truck 10. Intermediate nozzle 81 is mounted on top of cross rod 90 at a location between what will be right and left lane vehicle wheel tracks. The rearwardly directed streamer nozzle 81 is configured with a nozzle axis (not shown) which is substantially parallel with the surface of pavement 24 such that its orientation is the same as nozzles 80 and 82. The close proximity of the axes of nozzle 80–82 to the roadway pavement surface 24 permits their expression of a volumetrically controlled stream of liquid from their tips at a location avoiding wind turbulence developed by the forward movement of truck 10. That volumetric rate of liquid expression is controlled such that, in effect, a theoretical cylinder of liquid is generally horizontally projected rearwardly at a flow velocity having a horizontal velocity vector corresponding with the forward velocity of vehicle 10. Accordingly, there will be no relative motion between the stream of liquid and the surface of pavement 24. The expressed streams of liquid drops to the pavement under the influence of gravity with very little overspray or splash. The inputs of nozzles 80–82 are in fluid transfer communication via respective brine carrying hoses 100–102, with the pump outputs of three discrete combined hydraulic motors and pumps represented at respective blocks 104–106.

Figure 4:
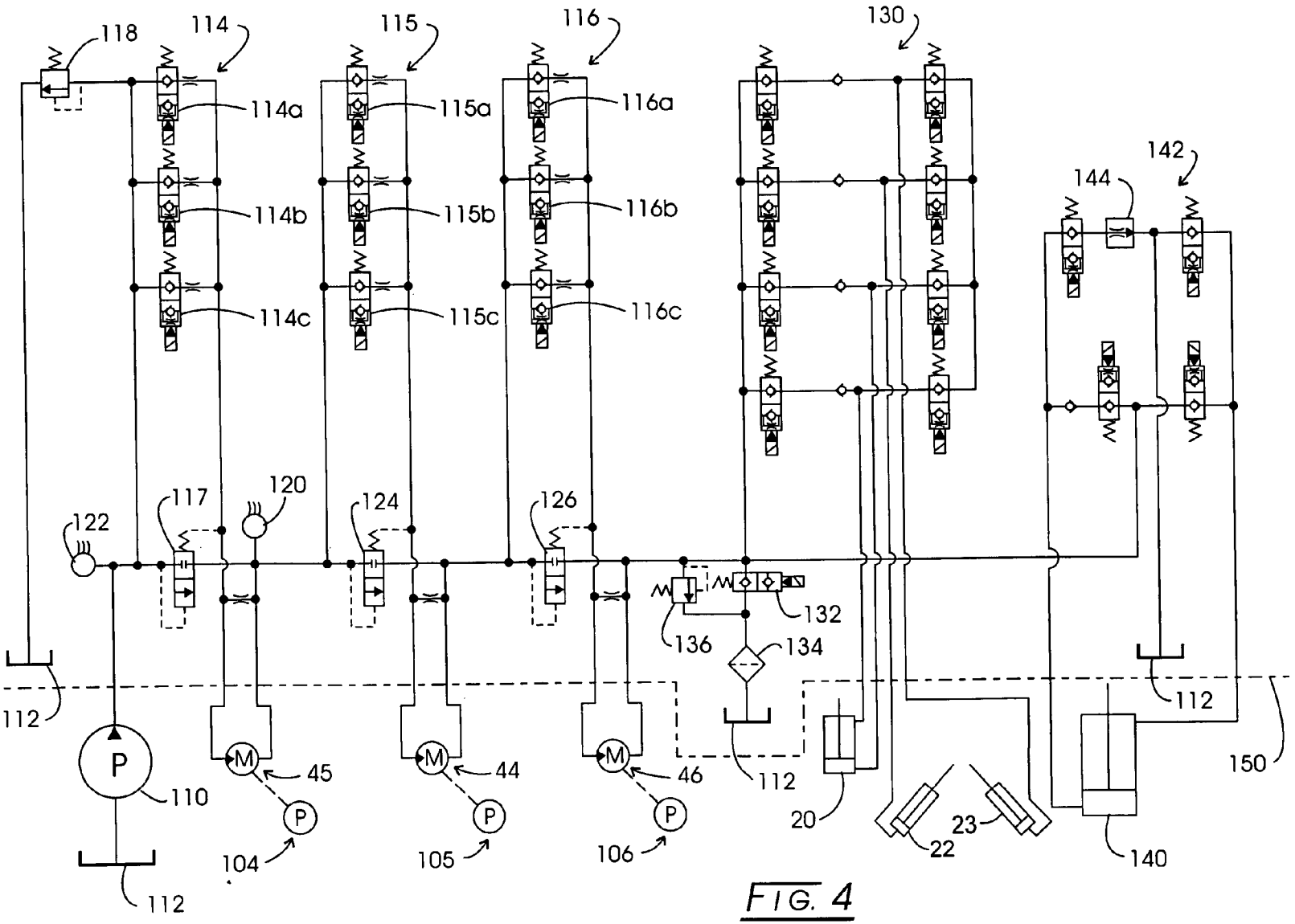
FIG. 4 is a hydraulic circuit diagram showing a hydraulic circuit embodiment which may be employed with the truck of FIGS. 1 and 2.

Referring to FIG. 4, the hydraulic system employed with the vehicle 10 and the snow-ice control apparatus with which it is configured is illustrated. Hydraulic motor 44 reappears as it would be coupled in driving relationship with spinner 42 (FIG. 1). The hydraulic motor employed to drive the auger assembly 38 is represented at 45; and the hydraulic motor employed to drive a wetting pump is represented at 46. When configured to operate the brining pretreatment apparatus 52, motor 45 would be configured with a pump in the manner described at 104 in FIG. 3; motor 44 would be configured with a brine pump in the manner described at 105 in FIG. 3; and motor 46 would be configured with a brine pump in the manner described at 106 shown in FIG. 3. A fluid pressure sensor or transmitter is shown at 122 which is responsive to the output or outputs of valves in the array 114 as they extend to the input of hydraulic auger motor 45. With this arrangement, the difference or differential between the outputs of the low pressure sensor and the high pressure sensor can be employed in conjunction with a motor speed responsive lookup table and a pre-assigned lower threshold value, for example, 50 psi to develop a signal representing an evaluation of the auger motor 45 load value. That same load value can be employed to determine when the granular salt supply to the auger has reached a low level.

Digital binary solenoid or electrically actuated valve array 115 functions to control the speed of motor 44, for example, driving spinner 42. The array is seen to be comprised of valves 115*a*–115*c* which perform in the same manner as the valves at array 114. A compensator is shown at 124 which functions with the same general purposes as compensator 117.

Binary digital electrically or electromagnetically actuated valve array 116 functions to control the speed of motor 46 and functions in the same general manner as the valves of arrays 114 and 115. The motor 46 may be employed to drive a wetting function pump or a brine distribution system nozzle pump as described in connection with FIGS. 2 and 3. A compensator 126 functions with the same general purpose as compensators 117 and 124. Forward plow 18 of vehicle 10 is controlled by the array of solenoid or electrically actuated valves represented generally at 130. The hydraulic cylinder providing plow lift and lowering is represented schematically with the same numeration shown in FIGS. 1 and 2 at 20, while the front plow angle control hydraulic cylinders are schematically represented at 22 and 23. A bypass valve is shown at 132. Valve 132 is normally open to assure that no hydraulic pressure is associated with the bed or plow unless needed. A return filter is shown at 134 and a relief valve is represented at 136. A bed hoist hydraulic cylinder is symbolically represented at 140. Cylinder 140 is controlled by valves of a valve array represented generally at 142. Valves of the array 142 perform in conjunction with a compensator 144 which functions to assure constant bed velocity in a down direction notwithstanding the amount of load it is carrying.

With the precepts of the present invention, all of the components, inter alia, represented in FIG. 4 above the dashed line 150 are retained within the hermetically secure reservoir and manifold composite assembly shown in conjunction with FIGS. 1 and 2 at 50. The discourse now turns to that feature.

Figure 5:
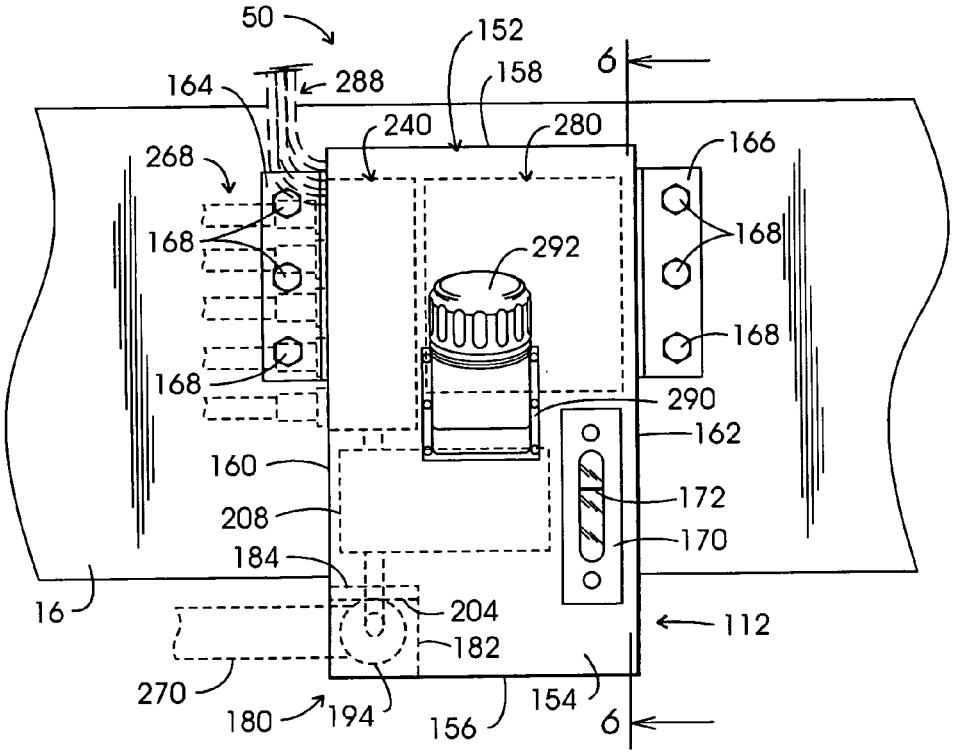
FIG. 5 is a front elevational view of a hermetically secure reservoir and manifold composite assembly employed with the system of the invention.

Referring to FIG. 5, the composite assembly 50 is illustrated in a figure looking to its front face. The assembly 50 is configured with a hermetically secure rectangular housing represented generally at 152 with a forward side 154; a bottom side 156; a top side 158; and flanking sides 160 and 162. Housing 152 is mounted interiorly against frame member 16 of truck 10, such mounting being accomplished with steel angle members 164 and 166 mounted to respective flanking sides 160 and 162. Attachment of the angle members 164 and 166 to frame 16 is carried out by utilizing bolt and nut combinations certain of which are represented at 168. Because the composite assembly 50 is intended, inter alia, for facile mounting on relatively smaller trucks it was determined to be desirable to provide hydraulic reservoir portion of it at a minimum volumetric size. In this regard, typically one gallon of reservoir capacity is provided for each gallon per minute capacity of the pump 110 (FIG. 4). That reservoir size is necessary in order to permit the aerating turbulence created by the system within the reservoir to diminish to a point where it will have been deaerated. With assembly 50, the reservoir represented generally at 112 is designed with a capacity less than the above-noted rule-of-thumb carrying slightly over one-half the capacity called for by that rule. For example, where twelve gallons would be called for under the rule, the reservoir portion 112 would contain 6–8 gallons. Reservoir 112 is shown in FIG. 5 in conjunction with a sight gauge 170 attached to forward side 154. Note that gauge 170 reveals a reservoir hydraulic fluid level at 172.

Figure 6:
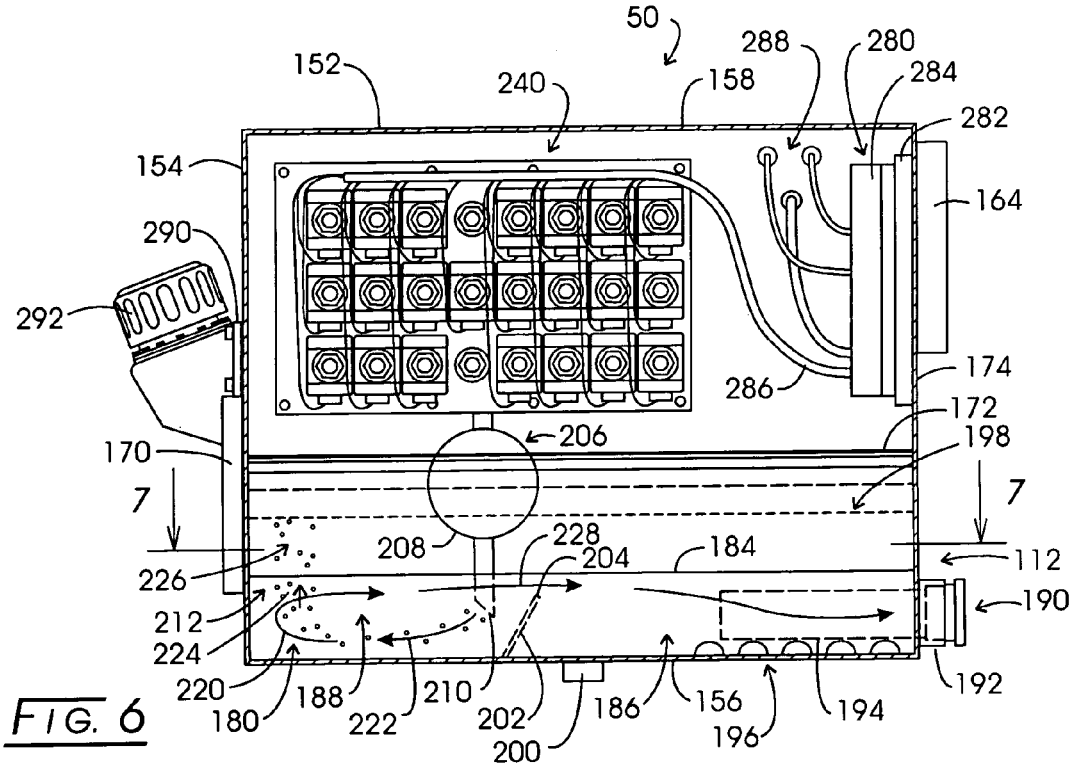
FIG. 6 is a sectional view taken through the plane 6—6 in FIG. 5.

Looking additionally to FIG. 6, reservoir portion 112 of composite assembly 50 is seen to be retained within a region bounded by forward side 154, flanking sides 160 and 162, bottom side 156 and rearward side 174. Shown in these figures adjacent flanking side 160 and bottom side 156 is an elongate fluid receiving chamber represented generally at 180 formed with bottom wall 156 and sidewall 160 in combination with an interior sidewall portion 182 and a top side or portion 184. Looking to FIGS. 6 and 7, chamber 180 is configured with a fluid dispensing region represented generally at 186 and a fluid receiving region represented generally at 188. Fluid dispensing region 186 is configured with a suction outlet represented generally at 190 configured as a suction port 192 extending through rearward wall 174 and incorporating a suction strainer 194 (FIG. 6) an array of inlet ports represented generally at 196 and formed within interior sidewall 182 of chamber 180. Inlet ports 196 provide fluid flow communication with that region of the reservoir 112 and somewhat directly above it is represented in general at 198. A fluid drain port and float assembly is represented at 200.

Figure 7:
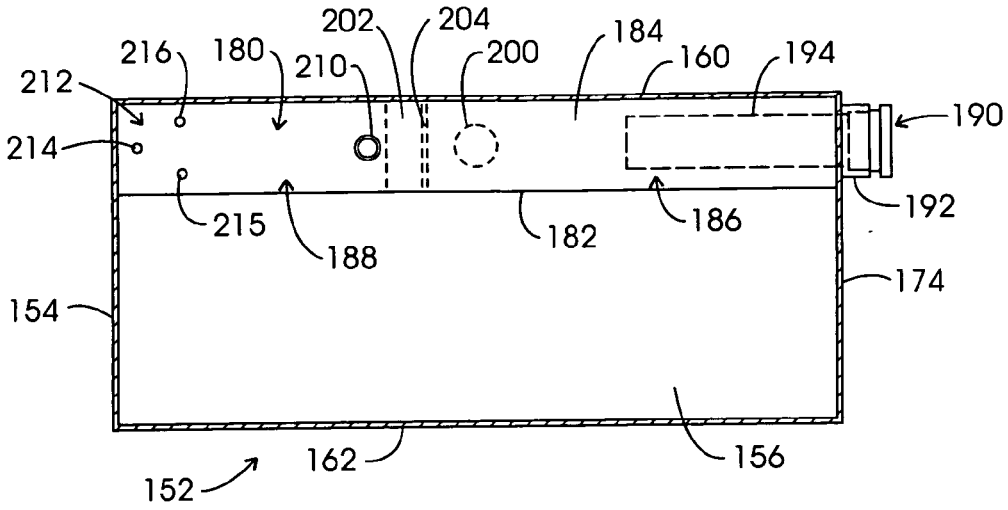
FIG. 7 is a sectional view taken through the plane 7—7 shown in FIG. 6.

FIGS. 6 and 7 reveal that a rectangularly-shaped baffle extends upwardly within fluid receiving chamber 180 from bottom side 156 to a baffle top spaced from chamber top side or portion 184. The baffle is located intermediate the fluid dispensing region and the fluid receiving region and is slanted toward the fluid dispensing region 186. Hydraulic fluid returns to the reservoir portion 112 via a return conduit represented generally at 206 incorporating a filter and extending to a return fluid outlet 210 located within fluid receiving region 188. Located within fluid receiving region 188 remotely from the baffle 202 and outlet 210 is an outgasing transfer portion of fluid receiving chamber 180 as represented generally at 212 and, as seen in FIG. 7 is formed of three air or gas transfer apertures 214–216. Note that return fluid outlet 210 is configured as a conduit opening which is upwardly slanting toward the vicinity of the outgasing transfer portion 212. As represented by arrows 220 and 222 any hydraulic fluid which evidences an air entrainment will be directed by outlet 210 and baffle 202 toward the outgasing transfer portion 212. As represented at arrow 224, any entrained gas bubbles will exit through transfer apertures 214-216 (FIG. 7) to a region represented generally at 226 in FIG. 6 of reservoir portion 112 so as not to adversely affect hydraulic fluid which is drawn through suction outlet 190. As represented at arrows 220 and 228, de-gassed hydraulic fluid also may circulate above the top 204 of baffle 202 toward suction an outlet 190.

Figure 8:
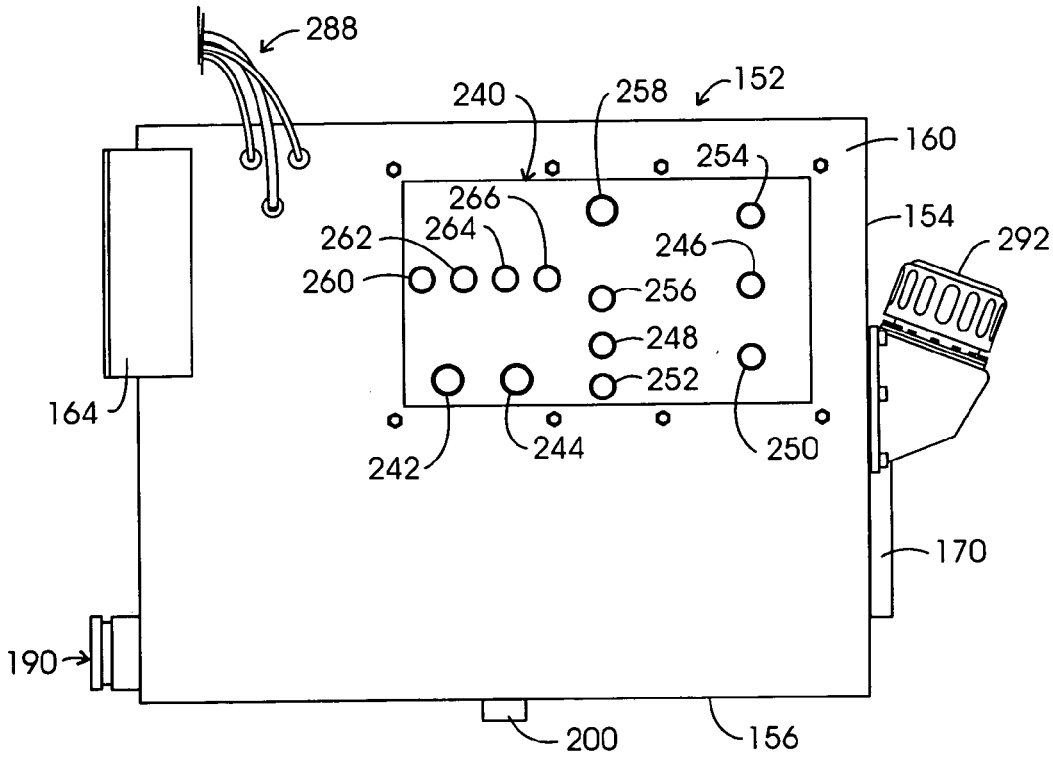
FIG. 8 is a side-elevational view of the apparatus of FIG. 5.

Additionally retained within the hermetically secure housing 152 is a manifold portion represented generally at 240 in FIGS. 5, 6 and 8. Located above the reservoir portion fluid level 172, manifold portion 240 supports a plurality of electrically actuated hydraulic valves sometimes referred to as "solenoid valves" as well as other components certain of which have been described as being located above the dashed line 150 in FIG. 4. These valves communicate in hydraulic fluid controlling relationship with fluid pressurized from pump 110 (FIG. 4) and the various hydraulically actuated components associated with truck 10. FIG. 8 reveals the ports to which these lines are connected through flanking side 160 of hermetically secure housing 152. In this regard, a bed down port is shown at 242, while a bed up port is shown at 244. A spinner pressure port is shown at 246, while a spinner return port is shown at 248. A brine wetting pressure port is shown at 250, while a corresponding wetting return port is shown at 252. The auger pressure port is shown at 254 while the auger return port is shown at 256. Pump 110 pressure port is shown at 258. Ports related to plow 18 include a plow lift port 260; a plow down port 262; a plow right port 264; and a plow left port 266. An array of certain of the hydraulic lines associated with the above-discussed ports is shown in phantom in general at 268 in FIG. 5. Also shown in phantom in that figure is a suction line 270.

Control, inter alia, of the array of electromagnetically actuated valves at manifold portion 240 is provided by a composite control assembly represented in general at 280 in FIG. 6. In that figure, the control assembly 280 is seen to comprise a circuit board 282 and associated connector component 284. From that connector component, a multi-lead cable 286 is seen extending to the arrayed electromagnetic valves. An array of certain of the cables is seen extending to the composite control assembly 280 as represented in general at 288. In this regard, the system at hand is one wherein it is deemed beneficial to avoid penetration of the cab 12 of truck 10 with a multitude of electrical lines. Accordingly, electrical inputs otherwise extending to cab 12 are instead extended to the hermetically secure composite assembly 50. Circuit board 282 will incorporate a composite assembly controller which performs in slaved fashion to a master controller mounted within cab 12. Essentially the only communication or penetration into cab 12 from assembly 50 will be a bidirectional data transmission bus which may be of a robust variety and a substantial portion of the electrical hardware of the system will be protected in the hermetically secure housing 152. That securement is enhanced by maintaining a positive gas pressure within housing 152, for example, about 5 psi. Such pressure initially is developed as a natural consequence of the operation of the hydraulic circuitry of the system. However, it is maintained at the hydraulic fluid filler port 290 located above fluid level 172 at forward side 154. That port 290 is provided in conjunction with a pressurizing filler breather cap 292. Cap 292 is similar to a conventional breather cap but incorporates a relief valve set at 5 psi and a vacuum breaker. Such breather caps can be provided as a model 57XL-40P-5 pressurized filler-breather cap marketed by Lenz Corporation of Dayton Ohio.

Figure 9A:
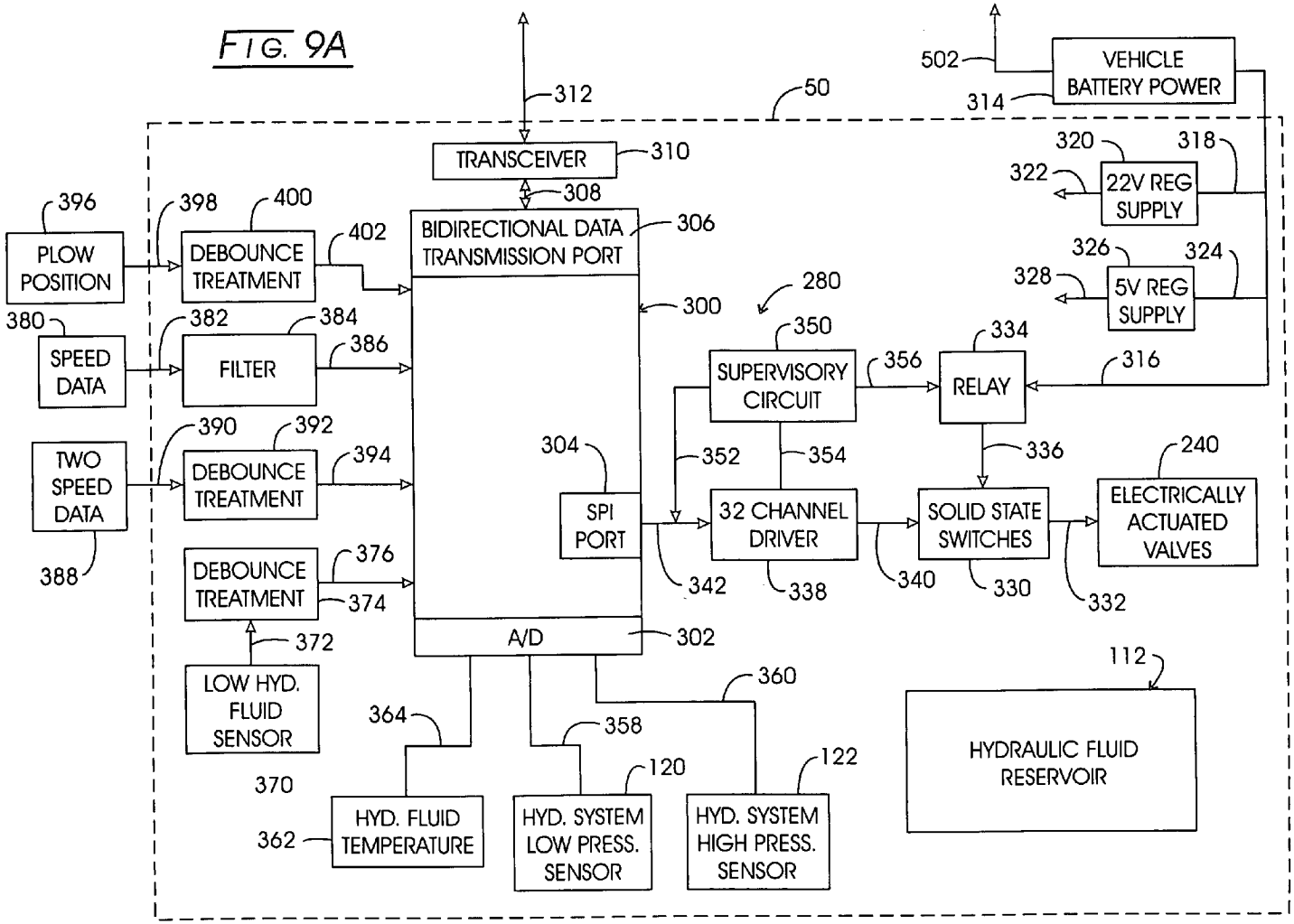
FIG. 9A illustrates a schematic block diagram of components within the composite assembly of FIG. 5.
Figure 9B:
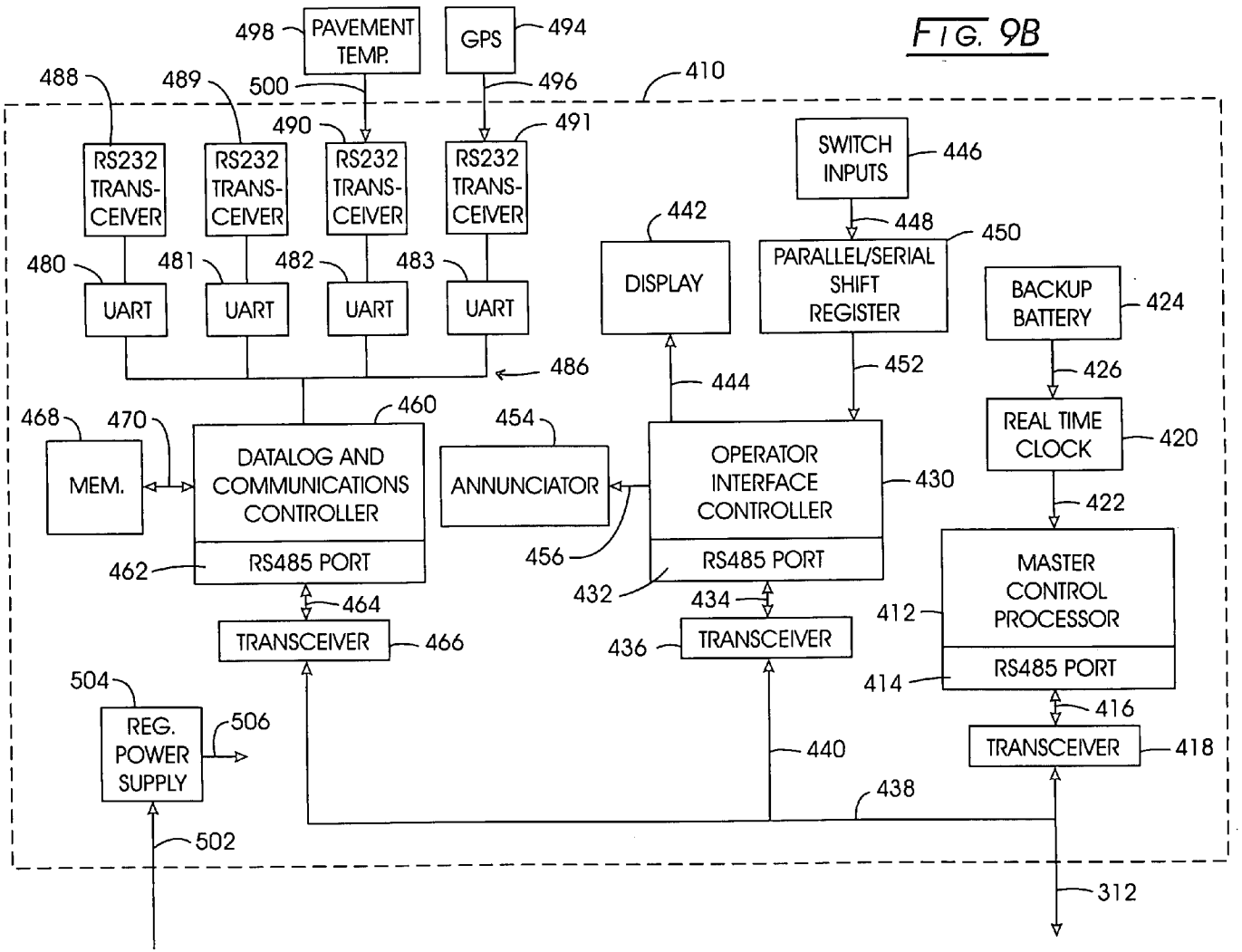
FIG. 9B is a schematic block diagram of control components mounted within an operator accessible control console located within the cab of the truck of FIGS. 1 and 2.

Referring to FIGS. 9A and 9B, the external connections to and components within hermetically secure composite assembly 50 are represented in schematic form. In this regard, the hydraulic fluid reservoir portion identified at 112 is shown in block form with that same numeration. Further, the electrically or electromagnetically actuated valve-containing manifold portion 240 is represented in block form with that same numeration. The composite control assembly 280 is again identified in general with that numeration looking to a variety of functions for electronic hardware components represented in block form. Within the composite control assembly 280 there is provided a composite controller represented generally at 300 which may be provided as a type PIC16876 assembly high performance, ENHANCED flash microcontroller which incorporates a 10-bit analog-to-digital converter as well as a serial peripheral interface (SPI) port function which may be configured to support Recommended Standard 485 (RS-485) bidirectional data transmission. The device is marketed, for example, by Microchip Technology, Inc. In FIG. 9, the analog-to-digital function is represented at sub-block 302. An SPI port is represented at sub-block 304 and a bidirectional data transmission port associated with the noted RS-485 bus is represented at sub-block 306. The latter sub-block is seen associated with serial communications dual directional arrow 308 extending to a transceiver function represented at block 310. Transceiver 310 provides a level shift for RS-485 functioning and may be provided, for example, as a type DS75176BT transceiver marketed by National Semiconductor Corporation. Shown bidirectionally interactively associated with transceiver 310 is bidirectional arrow 312. Arrow 312 represents a bidirectional serial data bus of type RS-485. This type bus is characterized by its robust nature, particularly being suited to the severe environments encountered by truck 10. See generally, "National Semiconductor Application Note AN-1057, 1998. It is essentially this singular robust single twisted pair that penetrates cab 12 to a console contained master controller. That master controller will provide command inputs and interrogate inputs to composite assembly controller 300 via bus 312. Power to the control components 280 as well as to the electrically actuated valves at manifold portion 240 is supplied from the battery of truck 10. Accordingly, such a battery is represented at block 314 located without the dashed boundary 50. The 12 volt output of battery 314 is submitted, as represented at line 316, to the interior of composite assembly 50. Within the protective environment of that composite assembly 50, the battery output is treated as represented at line 318 and block 320 to provide a regulated 22 volt power supply, for example, for use by analog components. Distribution of this supply as represented at arrow 322. In similar fashion battery output as represented at line 316 is tapped as represented at line 324 and block 326 to provide a regulated 5 volt power supply employed by components utilizing TTL voltage levels. Distribution of this power source is represented at arrow 328. The electrically actuated valves at 240 are actuated by solid-state switches as represented schematically by block 330 and control inputs represented by arrow 332 extending to block 240. These solid-state switches may be provided, for example, as type VNP10N07 FI power MOSFETs marketed by SGS-Thomson Microelectronics, Inc. Power is supplied to these switching devices for purposes of actuating the electromatically actuated valves of manifold portion 240 from the vehicle battery power input as represented at arrow 316. Note that arrow 316 extends to a power relay represented at block 334. From that relay 334 as represented at arrow 336 power for valve actuation is supplied to the solid-state switches 330. The solid-state switches 330 are activated from a 32-channel driver function as represented at block 338 and driver signals represented at arrow 340. Device 338 may be provided, for example, as a type HV9308, 32-channel serial to parallel converter with high voltage push-pull output marketed by Supertex, Inc. Such devices consist of a 32-bit shift register, 32 latches, and control logic to enable outputs. Driver function 338 receives controller outputs from SPI port function 304 of composite assembly controller 300 as represented at arrow 342.

Because of the importance of the functioning of composite assembly controller 300 in conjunction with the operation of the electrically actuated valves at 240, composite control assembly 280 incorporates a supervisory circuit represented at block 350. Supervisory circuit 350 may be provided, as a type MAX705 Microprocessor Supervisory Circuit marketed by Maxim Integrated Products, Inc. Device 350 is shown associated with SPI port 304 and its output at arrow 342 represented at arrow 352; with driver function 338 as represented at line 354; and in controlling relationship with relay function 334 as represented at arrow 356. Sometimes referred to as a "watchdog", device 350 provides an output 356 to relay 334 which will open the relay to remove power from switches 330 in the event that a watchdog input to deice 350 has not been toggled within 1.6 seconds. This will shut the manifold components down and that condition will be detected by the master controller upon the occurrence of an assertion of an interrogate command to composite assembly controller 300 calling for the status of the MOSFETs at switch function 330. Upon such shutdown the master controller will cause a warning to be presented to the operator of truck 10. Device 350 also will monitor for low voltage conditions. In the presence of such conditions relay function 334 will be opened.

The analog-to-digital function 302 of composite assembly controller 300 receives and converts the analog signal from the hydraulic system low pressure sensor earlier-described at 120. That function is represented as a block in the instant figure with the same identifying numeration. An analog signal from the sensor 120 is shown being asserted to the conversion function 302 as represented at line 358. In similar fashion, the hydraulic system high pressure sensor earlier described at 122 and represented in block form with that same numeration in the instant figure provides an analog signal to the conversion function as represented at line 360. The master controller will be seen to submit an interrogation command to composite controller 300 on a periodic basis both for monitoring these hydraulic pressures with respect to their falling within an acceptable range of pressure as well as to utilize the data thus collected to evaluate whether or not the auger function is performing in conjunction with a low salt load. The output of these pressure sensor functions also can be employed for determining fault conditions such as, for example, a stalled auger. In addition to the monitoring of hydraulic fluid pressures, as represented at block 362 the hydraulic fluid temperature also is monitored for a variety of reasons including calibration and over-temperatures with respect to an over-temperature threshold calling for hydraulic system shutdown. The analog temperature output of function 362 is submitted as represented at line 364 to the conversion function 302. It is acquired by the master controller function upon assertion of an interrogate command through bus 312.

Also located within composite assembly 50 is a low hydraulic fluid level sensor, the function of which is represented at block 370. Function 370 provides a contact closure form of output as represented at arrow 372. This switched form of signal at arrow 372 is treated, for example, being de-bounced as represented at block 374, whereupon, as represented at arrow 376 it is submitted to composite assembly controller 300. As before, upon assertion of an interrogative input from the master controller at serial bus 312, low fluid information will be conveyed to the operator of truck 10.

Truck speed data is externally derived as represented by block 380 located without dashed boundary 50. This speed data may, for example, be provided in bit fashion, 40,000 bits corresponding with one mile of travel. Such data is supplied, as represented at arrow 382 to the composite assembly 50. Within the hermetically secure environment, the data as represented at arrow 382 is filtered as represented at block 384, whereupon it is submitted to the composite assembly controller 300 as represented at arrow 386. In general, it is convenient to provide composite assembly controller 300 with a program converting the speed data to velocity for presentation to the cab 12 mounted master controller upon receipt of a corresponding interrogate input via bus 312. Because some trucks will have a dual transmission range, such status data is required by the control system. In this regard, externally derived two-speed data is represented at block 388 located without boundary 50. The two-speed contact closure form of information is presented, as represented at arrow 390, to a signal treatment network 392 within the hermetically secure composite assembly 50, whereupon it is de-bounced and, as represented at arrow 394, submitted to composite controller 300.

Another externally located sensing function provides information as to plow position or status, i.e., is it up or down. This contact closure form of signal is represented at block 396 without boundary 50 and is asserted, as represented at arrow 398, to signal treatment, for example, de-bounce treatment, at a network represented at block 400 within the hermetically secure composite assembly 50. The treated signal for plow position then is submitted to composite assembly controller 300 as represented at arrow 402.

An operator interface console is readily mounted within cab 12 in view of the essentially singular RS485 transmission bus connection with it. The console will incorporate the noted master controller, an operator interface controller and a data log and communications controller. The latter two controllers are slaved to the master control processor.

Referring to FIG. 9B a dashed boundary 410 is presented to represent the cab 12 mounted console assembly. Within boundary 410 the above-discussed master controller or master control processor is represented at block 412. Device 412 may be provided as a model PIC18F252/40-pin 8-bit CMOS flash microcontroller marketed by Microchip Technology, Inc. As represented at sub-block 414 device 412 is configured with an RS 485 port which communicates, as represented at dual directional arrow 416, in serial fashion in conjunction with a transceiver represented at block 418 with the RS 485 linkage described earlier in connection with FIG. 9A at arrow 312. Transceiver 418 may be identical to that described earlier at 310. Associated with the master controller 412 is a real-time network clock as represented at block 420 and arrow 422. Clock function 420 is provided with battery back-up as represented at block 424 and arrow 426. Clock 420 may be provided as a type DS1307 64×8 serial real-time clock marketed by Dallas semiconductor, Inc.

The operator interface controller is represented at block 430. Device 430 may be of the earlier-described type PIC16F876, marketed by Microchip Technology, Inc. As represented at sub-block 432, device 430 may be employed with an RS 485 linkage for that purpose, as represented by dual arrow 434 and block 436. For this purpose, the device 430 is combined with a transceiver which is identical to that described earlier at 310 in FIG. 9A. Transceiver 436 is seen to be in communications with RS 485 communications link 312 as represented at lines 438 and 440. Interface controller 430 functions as a slave under the control of master control processor 412 to drive an LCD display as represented at block 442 and arrow 444. Additionally as represented at block 446 and arrow 448, controller 430 monitors front panel switches of the console. As represented at block 450 and arrow 452 representing a serial peripheral interface bus, this monitoring of the switches is carried out through a parallel-in/serial-out 8-bit shift register which may be of a type MM74HC165, Marketed by Fairchild Semiconductor Corp. In addition to the visual cueing provided by the display function 442, as represented at block 454 and arrow 456, under the command of the master control processor 412, device 430 provides an aurally perceptible cue at an annunciator as represented at block 452 and arrow 456.

The third slave controller is a data log and communications controller represented at block 460. Also provided as a type PIC16F876 (supra) the device 460 incorporates an RS 485 communications capability as represented at sub-block 462. For that form of communication, as represented at dual arrow 464, a transceiver as represented at block 466 is used in conjunction with the data link represented at line 438. Transceiver 466 may be of the type described in connection with FIG. 9A at 310.

For its data log functioning, device 460 performs in conjunction with memory as represented at block 468 and dual arrow 470. Device 468 may, for example, be provided as a 32-megabit serial interface Flash memory type AT45 DB321B, marketed by Atmel, Inc.

The communications feature of device 462 permits the collection of substantial amounts of externally derived data. For example, device 460 is configured with four UARTs as represented at 480–483 in connection with a serial peripheral interface (SPI) bus function represented generally at 486 and four corresponding RS 232 transceivers 488–491. Devices 480–483 may be provided, for example, as a type MAX3100SPI/Microwire-Compatible UART in QSOP-16, marketed by Maxim, Inc. The RS 232 transceivers may be provided as type MAX202 RS-232 transceivers marketed by Maxim, Inc. With this arrangement, the device 460 may receive a variety of external data such as externally developed ground positioning system (GPS) inputs as represented at block 494 and arrow 496, as well as pavement temperature data as represented at block 498 and arrow 500.

Power is supplied to the console represented at boundary 410 from the battery of truck 10 as represented by arrow 502 extending from block 314 in FIG. 9A. Arrow 502 is seen to extend to a console mounted power supply 504, a distribution of regulated power beam represented at arrow 506 extending from that block.

Communications between the master control processor 412 and controllers 430 and 460 also may be provided at TTL levels through a tri-state buffer (not shown). In this regard, a type 74HC126 high speed CMOS logic 3-state buffer marketed by Texas Instruments, Inc. of Dallas Tex. may be provided for this purpose.

Figure 10:
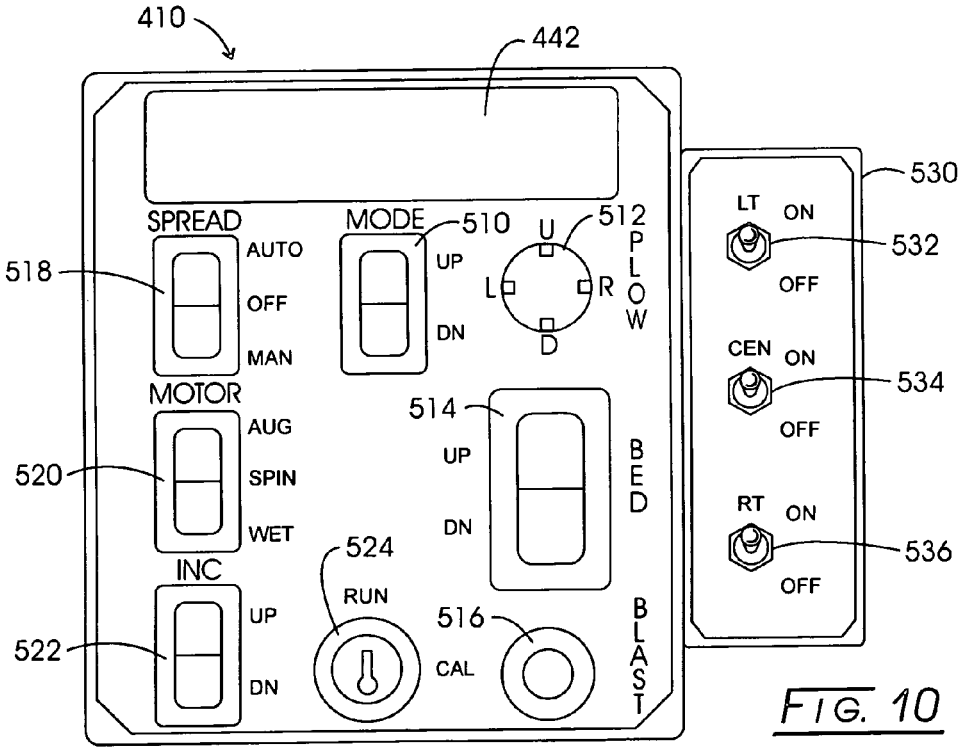
FIG. 10 is a front view of a control console which may be employed with the system of the invention.

Referring to FIG. 10, a front view of the control console 410 is provided. Display 442 is of a LCD variety and provides a broad range of visibly perceptible outputs to the operator. Initially, the operator may elect an operational mode by actuating the mode incrementing switch 510 up or down as the mode menu is sequentially displayed at display 442. The front plow is maneuvered up or down and left or right by manipulation of plow switch 512 and the truck bed 34 can be moved up or down by actuation of bed hoist switch 514. A blast switch 516 is pressed by the operator to cause the auger to operate at higher speed along with a spinner to temporarily distribute a larger quantity of salt, for example, when passing through intersections or over bridge decks. The button can be momentarily depressed. i.e., for a short interval and it will continue the blast activity for a predesignated blast interval. A general spreading activity is elected at spread switch 518. When actuated into the "auto" orientation the system deposits snow-ice control material with a ground speed orientation, i.e., the quantity is ejected in correspondence with vehicle forward speed. When switch 518 is in a manual position, then the operator selects all speeds of the components. Switch 520 is a motor selection switch wherein the operator can incrementally adjust the speeds of the auger motor, spinner motor or wetting motor by making incremental actuations either up or down at incrementing switch 522. Switch 524 is key actuated between a normal run position and a calibration position. Console 410 is configured with an auxiliary console or box 530 for utilization with the pre-treatment brine deposition arrangement described in connection with FIGS. 2 and 3. In this regard, switch 532 activates or enables brine nozzle 80 and associated motor-pump assembly 104. Switch 534 activates or enables central nozzle 81 and associated motor and pump assembly 105; and switch 436 selectively activates nozzle 82 and its associated motor and pump assembly 106. In general, the console 410 is designed for the above-discussed lighter trucks and therefore is somewhat simplified.

Figure 11:
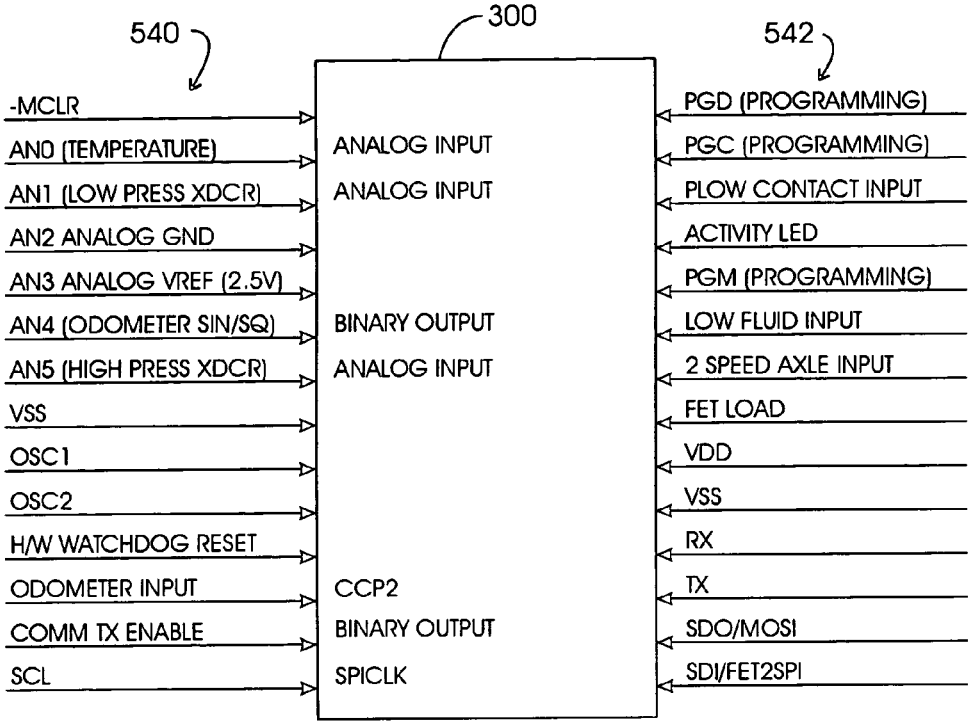
FIG. 11 is a pin-out schematic drawing of a composite controller shown in FIG. 9A.

Referring to FIG. 11, the pin-out for composite controller 300 is revealed. Looking to the pin array represented generally at 540, -MCLR is a memory clear line which generally is tied to a high logic level so as to remain out of memory clear. The pin is employed as part of programming procedures. The pins identified at AN0–AN5 are analog input ports as labeled. Each of the slave controllers is provided with its own crystal network which employ the OSC1 and OSC2 pins. Next, a hardware watchdog reset function pin provides for the resetting of supervisory circuit 350. The odometer input corresponds with line 386 described in connection with FIG. 9A. A COMM TX enable pin is a transmit enablement for the RS 485 communications link;

and the SCL pin provides a serial clock for SPI communication to 32-channel driver 338 (FIG. 9A). Now looking to oppositely disposed pin array 542, the PGD and PGC pins are employed for chip programming. The PLOW CONTACT INPUT pin corresponds with the input line 402 in FIG. 9A. Next an activity light emitting diode is employed for troubleshooting activities and the like. The PGM pin is employed for programming LOW FLUID INPUT at as discussed in connection with FIG. 9A at line 376 is next in the array. Similarly, the contact closure two-speed axle input pin corresponds with line 394 in FIG. 9A. The FET LOAD pin provides latch outputs for the 32-channel driver 338 (FIG. 9A) and the lower four pins comprise receive, transmit activities along with SERIAL DATA OUT and SERIAL DATA IN also associated with SPI lines.

Figure 12:
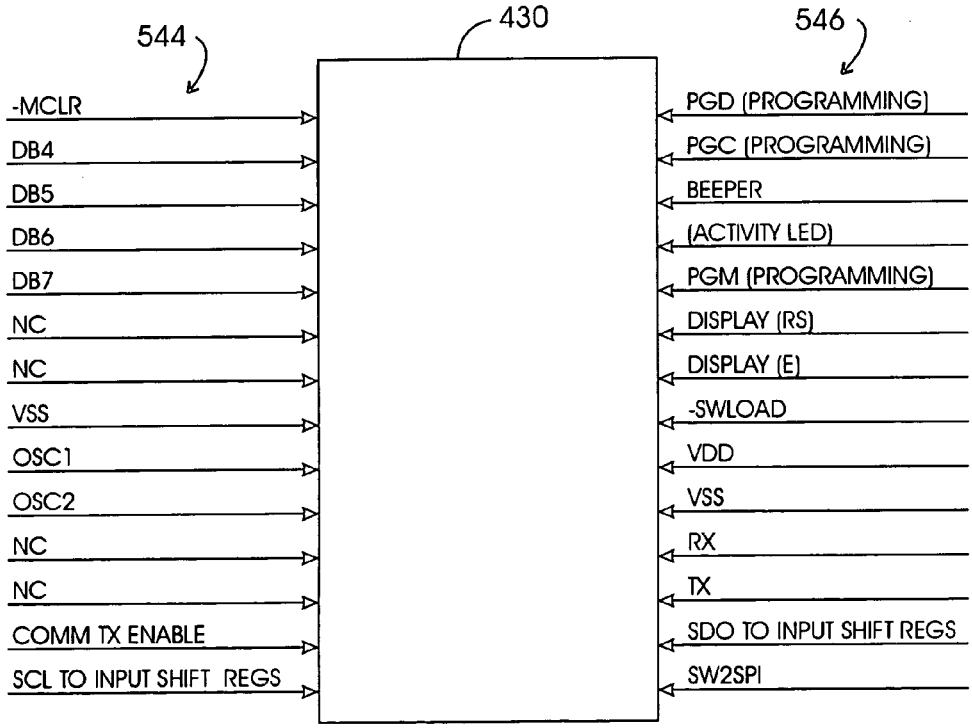
FIG. 12 is a schematic pin-out drawing of an operator interface controller described in connection with FIG. 9C.

Looking to FIG. 12 the pin-out of the operator interface controller 430 is set forth. Looking to pin array 544, again the -MCLR pin is normally held high to assure that memory is not cleared, the pin being employed as part of programming activity. Pins DB4–DB7 are employed as data bus lines for driving display 442 (FIG. 9B). Pins OSC1 and OSC2 are employed with a dedicated crystal oscillator. Next, a transmit enable line for the RS485 communication link is provided and a serial clock for the SPI communication features is provided. Looking to oppositely disposed array 546, three programming pins, PGD, PGC and PGM are provided. Line 456 extending to beeper 454 is identified under the label "BEEPER". An activity LED troubleshooting function described with the same pin label shown in array 542 is shown, DISPLAY (RS) is a register select pin and DISPLAY (EN) is a clock pin for clocking the information into the display 442. -SWLOAD pin represents an enable line for the shift registers 450. In this regard, there are five shift registers that acquire the switches at the control console. RX and TX are respective receive and transmit pins and the SDO to INPUT SHIFT REGS pin is a serial data output to the shift registers. The last pin (SW2 SPI) is a switch input to the serial peripheral interface.

Figure 13:
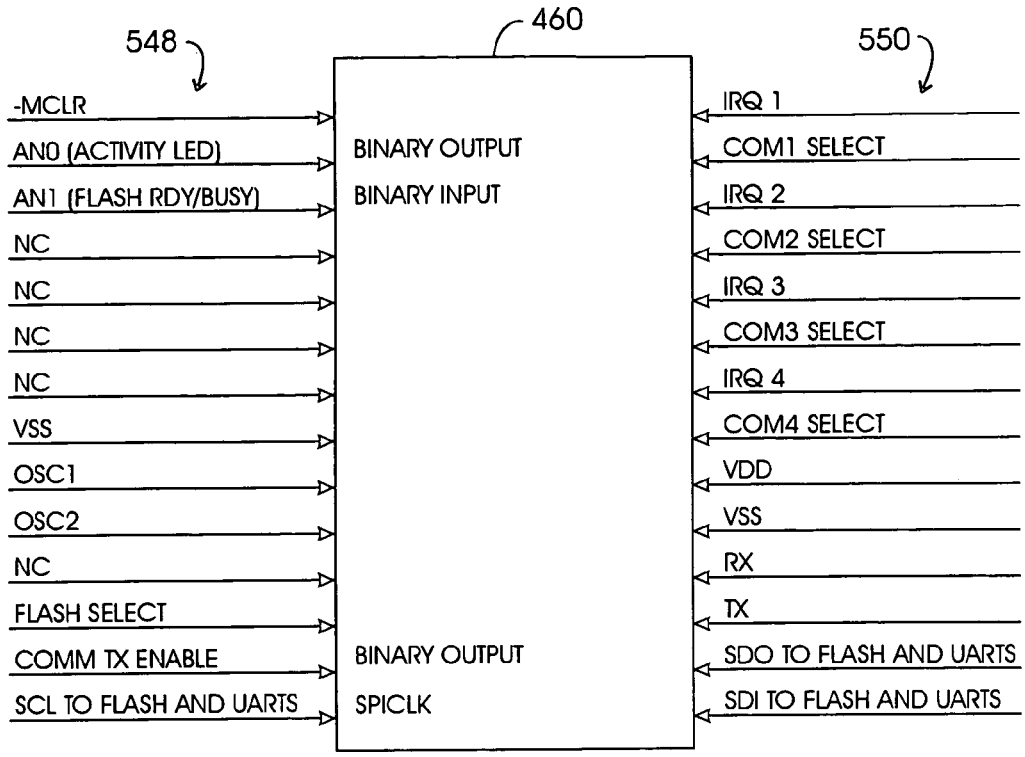
FIG. 13 is a schematic pin-out drawing of a datalog and communication controller shown in FIG. 9C.

The pin out arrangement for the data log and communications controller 460 is represented in FIG. 13. In pin array 548, following the memory clear and activity LED port, a pin AN1 is employed to determine whether the flash memory 468 (FIG. 9B) is busy or ready to receive data. As before, OSC1 and OSC2 are the pins associated with a dedicated crystal oscillator. Memory 468 is enabled by the pin labeled FLASH SELECT, and, as before, a transmit enable pin is next provided. The SCL to FLASH UARTS pin provides for the sharing of the SPI port.

Looking to pin array 550, the IRQ1–IRQ4 pins provide a chip selection function to UARTS 480–483. Also extending to those four UARTS are the COM1 SELECT–COM 4 SELECT pins. Following Receive (RX) and Transmit (TX) pins are two pins providing for Serial data out (SDO) and Serial data in (SDI) to the flash memory and UARTS.

Figure 14:
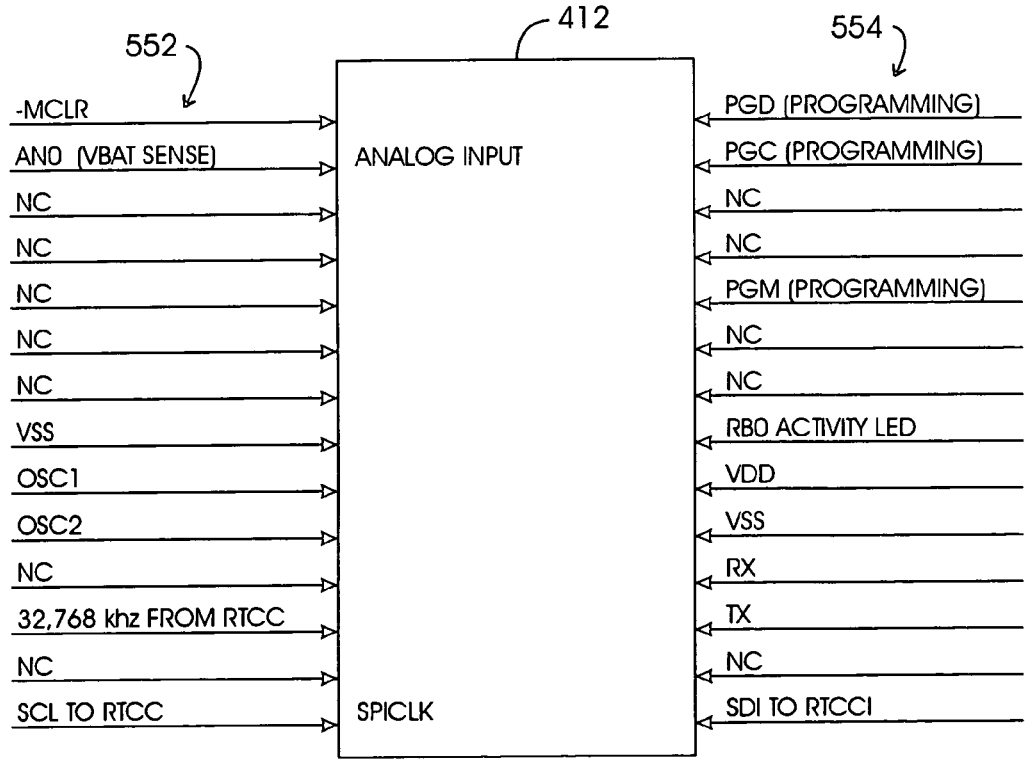
FIG. 14 is a schematic pin-out drawing of a master controller shown in FIG. 9C.

Looking to FIG. 14, the pin-out of the master control processor is revealed. Pin array 552 is shown to have a memory clear pin as before. The next pin provides for a sensing of the voltage of the battery of truck 10 inviting a corresponding readout at display 442. A dedicated crystal oscillator input is provided at OSCI and OSC2 and the system may make use of a 32,768 khz input from the real-time clock 420. The last pin provides a serial clock to the real-time clock 420.

Looking to pin array 554 those pins labeled PGD, PGC, and PGM are programming pins. The next used pin is another activity LED as described above. Serial data receipt port RX and serial data transmit port, TX are provided and, lastly, a serial data into the real-time clock port is provided.

Now looking to the program associated with the master and three slave controller components, at initial power-up each of the slaved controllers will carry-out a self check and the master controller will provide interrogate inputs to them to review that initialization status. Looking to FIG. 15, the power-up routine for the operator interface controller 430 is set forth as commencing with node 560 and line 562 extending to block 564. At block 564 controller 430 determines whether the parallel/serial registers described in connection with block 450 are in proper order and capable of receiving switch inputs. Next, as represented at line 566 and block 568 a query is posed as to whether the shift register tests were successful. In the event of a failure, then as represented at line 570 and block 572 a test fail message is issued to display 442 and as represented at line 574 and node 576 the program is halted.

Where the query posed at block 568 results in an affirmative determination, then as represented at line 578 and block 580 the LCD display 442 is issued a message to determine that all characters are operational. Next, as represented at line 582 and block 584 a query is again posed as to whether the test set forth at block 580 was successful. In the event that it was not, then as represented at lines 586 and 570 a fail message is submitted to the display 442 and, as before, the system halts. In the event of an affirmative determination with respect to the query posed at block 584, then as represented at line 588 and block 590 interface controller 430 creates a success code which will be submitted to the master controller in response to an interrogate input. In the latter regard, the slave controllers will only respond to the master controller to avoid cross talk. The interface controller then enters a slave mode as represented at line 592 and block 594.

Referring to FIG. 16, the power-up routine for slave composite controller 300 is set forth. This power-up routine commences at node 600 and line 602 extending to block 604. Block 604 provides for clearing all outputs to assure that there is no motion. Next, as represented at line 606 and block 608 the analog-to-digital converter system as described at sub-block 302 is initialized. Following such an initialization, as represented at line 610 and block 612, a success code is derived for submittal to the master controller in response to an interrogate input. Next, as represented at line 614 and block 616 the composite controller 300 enters a slave mode.

Figure 17:
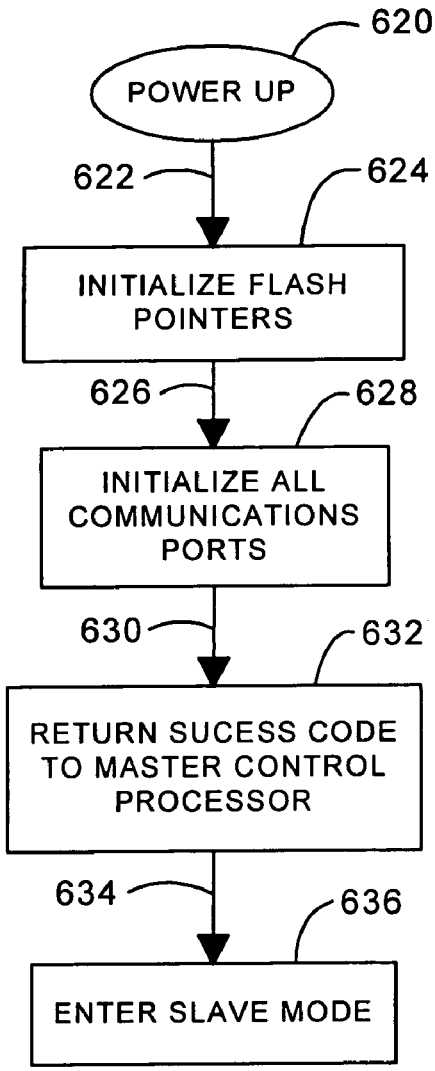
FIG. 17 is a flowchart describing a power-up procedure for the datalog and communications controller illustrated in FIG. 9C.

Looking to FIG. 17, the power-up routine for the datalog and communications controller 460 is set forth. This routine commences with node 620 and line 622 extending to block 624. At block 624, the memory flash pointers for memory 468 are initialized. Following this initialization, as represented at line 626 and block 628 all communication ports are initialized and, as represented at line 630 and block 632 a success code is prepared for submittal to the master controller in response to interrogate input. As represented at line 634 and block 636 controller 460 then enters a slave mode.

Figure 18:
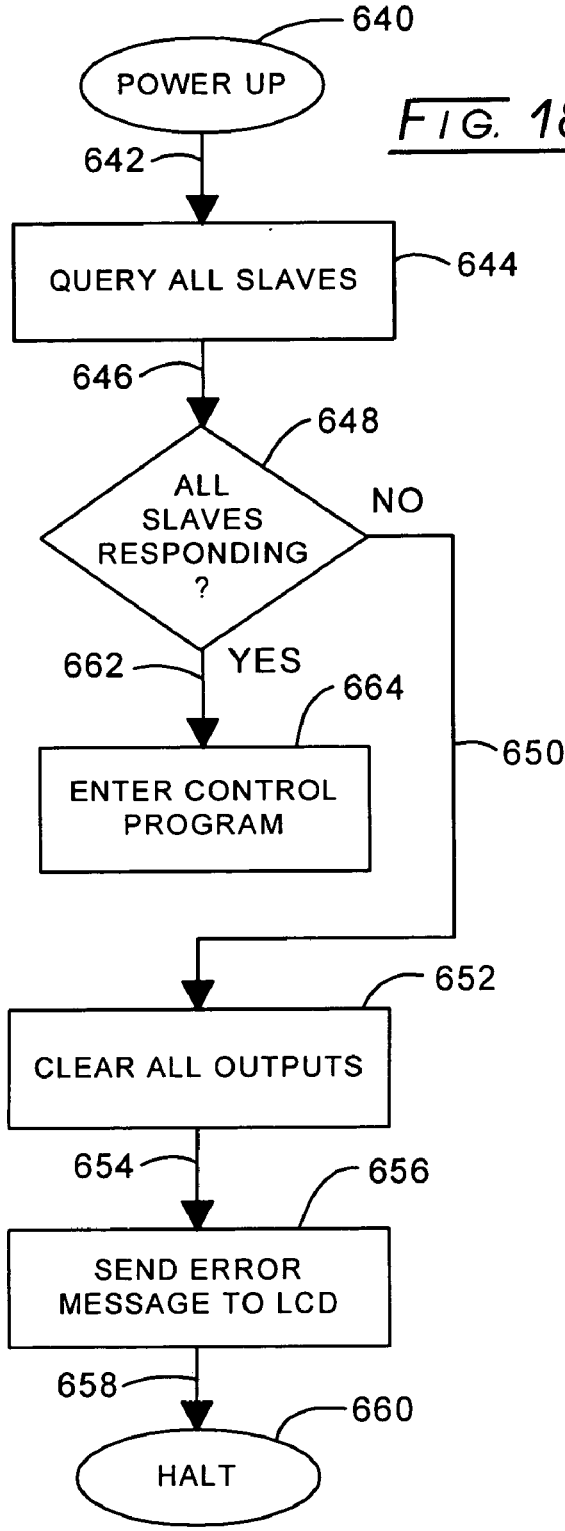
FIG. 18 is a flowchart describing a power-up procedure for the master control processor illustrated in FIG. 9C.

Now looking to the power-up routine of master control processor 412 reference is made to FIG. 18. In that figure, the routine is seen to commence with node 640 and line 642 extending to block 644. At block 644, the controller submits the earlier-discussed interrogate inputs to the slave controllers 300, 430 and 460. With such submittal, as represented at lines 646 and block 648 a query is posed as to whether all slaves computers have responded with a success code. In the event that they have not, then as represented at line 650 and block 652 all outputs are cleared and as represented at line 654 and block 656 an error message is sent to the display 442 and, as represented at line 658 and node 660 the system is halted.

Where the query posed at block 648 results in a receipt of success codes from all slave controllers, then as represented at line 662 and block 664 the master controller enters the main control program.

Figure 19:
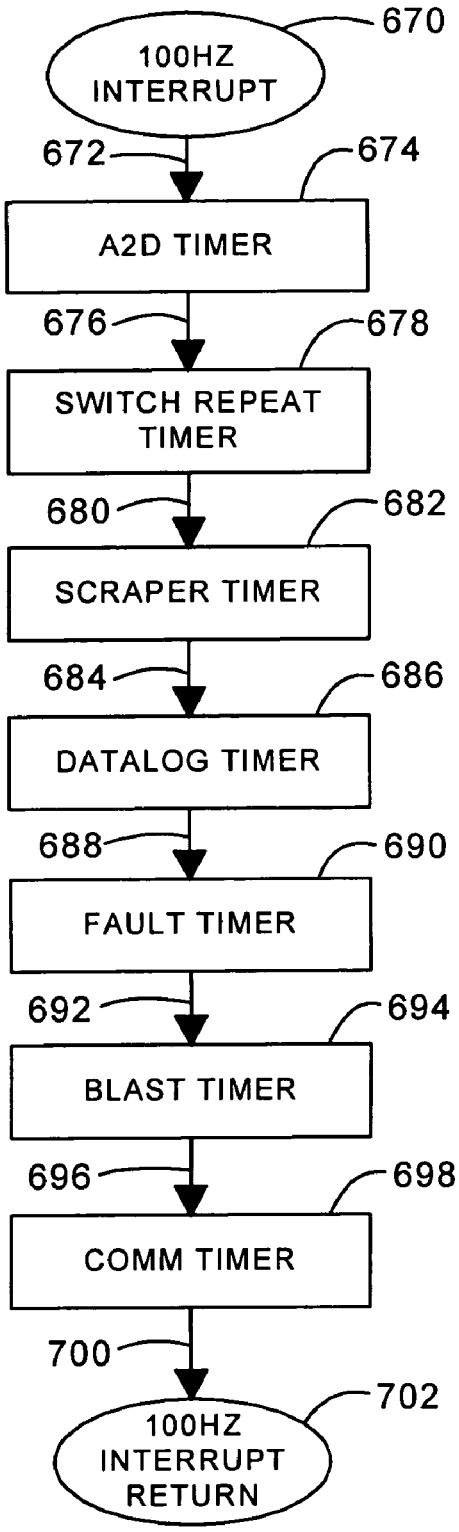
FIG. 19 is a flowchart describing a timing program employed by the master control processor shown in FIG. 9C.

The main control program is comprised of two components, one being a timer function serving at 100 hz to carry-out functional time-outs. Referring to FIG. 19, this timing feature is shown commencing with node 670 and line 672 extending to block 674. At block 674, the status of the analog-to-digital conversion function 302 is determined. Next, as represented at line 676 and block 678 a switch repeat timer is provided. This timer is used, for example, during calibration procedures when the calibrator is changing numbers. As a switch is held down to change numbers in successive increments the rate of change will increase depending upon this particular time-out. That provides calibration convenience. Next, as represented at lines 680 and block 682 a scraper timer is provided. For larger trucks, an under-frame scraper plow may be employed. Periodically, the hydraulic pressure applied to the scraper should be updated and the instant timer provides that timing function. The datalog function associated with controller 460 is periodically updated with information, for example, every five seconds as represented at line 684 and block 686. Where a fault has been determined to exist by the control system, then as represented at line 688 and block 690 the system determines whether the fault was spurious or not by timing out a threshold fault duration. If the fault does not persist for that duration, then it is not reported. The operator may wish to carry out a blast procedure for an extended period of time. Accordingly, as represented at line 692 and block 694 where the operator presses the blast button switch 516 for a very short interval the blast will continue for a timed blast interval. On the other hand, where the button switch is held down for a lengthier period then the blast interval will be determined by the length of time the button is depressed. A communications timer provides the time of day and is represented at line 696 and block 698. The program then returns as represented at line 700 and node 702.

Figure 20A:
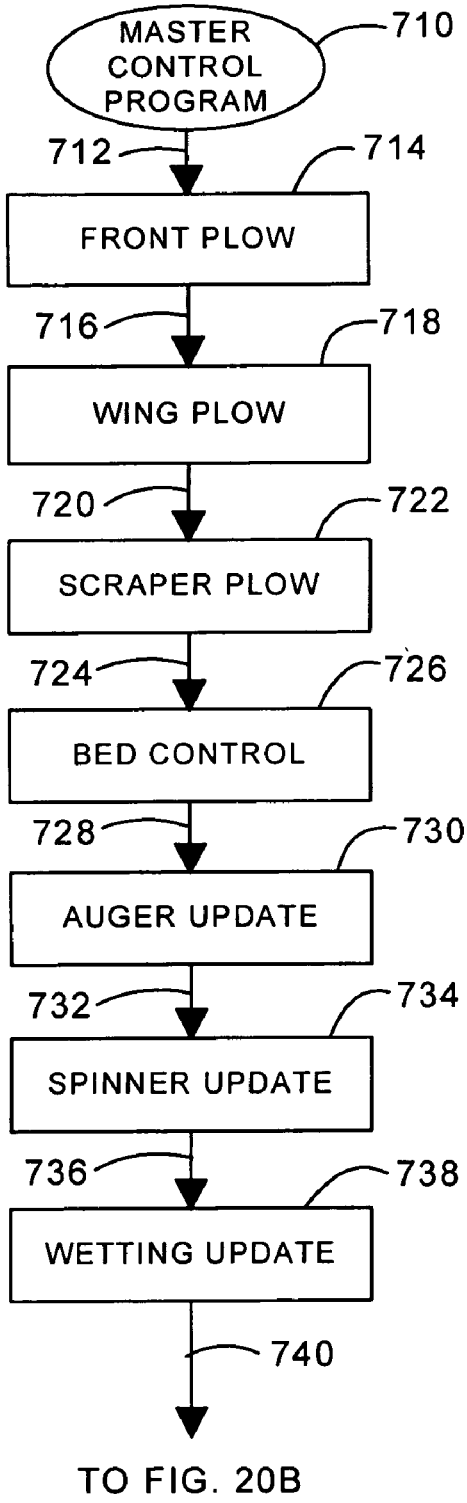
FIGS. 20A and 20B combine as labeled thereon to illustrate a flowchart of the master control program utilized by the master control processor shown in FIG. 9C.

Now looking to the master control program, in general this program will cycle through a sequence of interrogate and command inputs with respect to the various system functions. Looking to FIG. 20A, the program is seen to commence at node 710 and line 712 extending to the front plow function as represented at block 714. At this function, the controller 412 carries out the following tasks:

(1) Clear front plow related solid state switches of the array 330 upon entry.
(2) Check to see if the system is in a calibration mode.
(3) Check for plow vertical switch movement
(4) If retracting then check for the plow hydraulic cylinder configuration as to whether it is single or double acting.
(5) Set appropriate solid-state switch bits.
(6) Check for any horizontal switch movement.
(7) Set appropriate solid-state switching bit.
(8) Set the solid-state update bit in the event list to actually turn on the appropriate solid-state switches.

As represented at line 716 and block 718, where a wing plow is present, then the following tasks are carried out:

(1) Clear the wing plow solid-state switch outputs upon entry.
(2) Check to see if the system is in a calibration mode.
(3) Check for any vertical switch movement.
(4) Check set appropriate solid-state switch bit.
(5) Check for any horizontal switch movement.
(6) Set appropriate solid-state switch bit.
(7) Set the solid-state switch update bit in the event list to actually turn the appropriate solid-state switches on.

If there is a scraper plow within the system, then as represented at line 720 and block 722 the following tasks are carried out with respect to such scraper plow:

(1) Clear the scraper plow solid-state switch outputs on entry.
(2) Check to see if the system is in a calibration mode.
(3) Check for vertical switch movement with respect to the scraper plow.
(4) Set appropriate solid-state switching bits.
(5) If movement is down scraper mode is set to scrape-delay and a scraper timer is started based on a configuration value. This scraper timer is checked on the 100 hz tick event.
(6) Check for horizontal switch movement with respect to the scraper plow.
(7) Set appropriate solid-state switching bits
(8) Set the solid-state switching update bit in the event list to actually turn the solid-state switches on.

Next, as represented at line 724 and block 726 the following tasks are considered with respect to the dump bed control:

(1) Clear the bed control solid-state switch outputs on entry.
(2) Check to see if the system is in a calibration mode.
(3) Check to see if the dump bed is going down.
(4) Set the bed down solid-state switch bit.
(5) Check to see if the bed is going down fast.
(6) Set the bed down fast bit.
(7) Check to see if the hoist cylinder is double-acting or not.
(8) Set the pump and bypass solid-state switching bits if a double-acting configuration is at hand.
(9) Check to see if the dump bed is going up.
(10) Set the bed up solid-state bit.
(11) Set the solid-state switch update event bit to actually turn on the appropriate solid-state switches.

As represented at line 728 and block 730 the following auger update tasks are carried out:

(1) Clear the auger solid-state switch outputs on entry.
(2) Clear the pounds per mile and pounds per minute registers.
(3) Check to see if the spreader is active (this is true or false from the spreader update event—See block 742). Looking at the position of the spreader switch and manual on/off switch.
(4) Get auger switch setting.
(5) If manual switch orientation set the solid-state switches based on the switch setting.
(6) If in an automatic mode, index the configuration flow table based on the switch setting.
(7) Compute pounds per minute needed based on the speed of the truck.
(8) Convert pounds per minute to gallons per minute of hydraulic fluid based upon constant calibration.
(9) Set the auger solid-state switching bits.
(10) Set the wetter event bit to update the wetting output.
(11) Compute actual pounds per minute based upon the solid-state switching output.
(12) Convert pounds per minute to pounds per mile based upon the speed of the truck.
(13) Store answers in the pounds per minute and pounds per mile registers.

(15) Set the solid-state switch update event bit to actually turn on the solid state switches.

(16) Compute auger load from high and low hydraulic fluid pressure sensors.

As represented at line 732 and block 734 the spinner function is updated with the following tasks:

(1) Clear the spinner solid-state switch output on entry.

(2) Check to see if the spreader is active (true or false from the spreader update event—See block 742).

(3) Check to see if blasting.

(4) Check Zblast configuration, if so spin to maximum rate.

(5) If manual and spinner does not equal 15, set solid-state switch output bits to switch setting. (15 is a spreader motor speed intended for impeller use and not spinners).

(6) If spinner setting is 15 or more, must ground orient the spinner speed.

(7) Take 15 divided by the spinner MAX configuration then multiply by current speed to get the motor GPM setting needed.

(8) Check that the new motor GPM setting is not lower than the spinner minimum calibration setting.

(9) Set the spinner solid-state switch bits.

(10) Set the solid-state switch update event bit to actually turn on the solid-state switches.

A salt wetting with brine update is then addressed as represented at line 736 and block 738. Two types of wetting are involved, one being to apply brine to granular salt with a gallons per ton parameter and the other is to apply brine to roadway pavement with a parameter of gallons per mile. The following tasks are contemplated:

(1) Clear wetting solid-state switching outputs on entry.

(2) Clear gallons per mile and gallons per minute registers.

(3) Check to see if spreader is active (true or false from spreader update event—See block 742).

(4) Get wetter switch setting.

(5) Check to see if blasting. (If blasting in auto, output could be based on gallons per ton or could be set to MAX if spreading in gallons per mile. If in manual mode output is MAX).

(6) If manual mode, output is switch setting. Set wetting solid-state switch output bits.

(7) If in auto check to see which wetting mode is active.

(8) Auger-zero, spinner-zero, wetting non-zero, gallons per mile mode is active.

(9) If auger or spinner is non-zero then wetting mode is gallons per ton.

(10) If gallons per mile mode switch position, index flow table to set desired output rate in GPM.

(11) Compute gallons per minute (chemical) needed.

(12) Convert into a gallons per minute (hydraulic) rate based on calibration constant.

(13) Add in wetting slippage calibration value.

(14) Set the wetting solid-state switch bits.

(15) Compute actual gallons per minute and gallons per mile. Do not count slippage factor.

(16) If gallons per ton mode output is matched to salt output based on a percentage of a maximum calibration value, the percentage is the switch setting 1–10. Anything larger than 10 is 10 or 100%.

(17) Set the wetting solid-state switch bits.

(18) Set the solid-state switch update event bit to actually turn-on the solid-state switches.

Figure 20B:
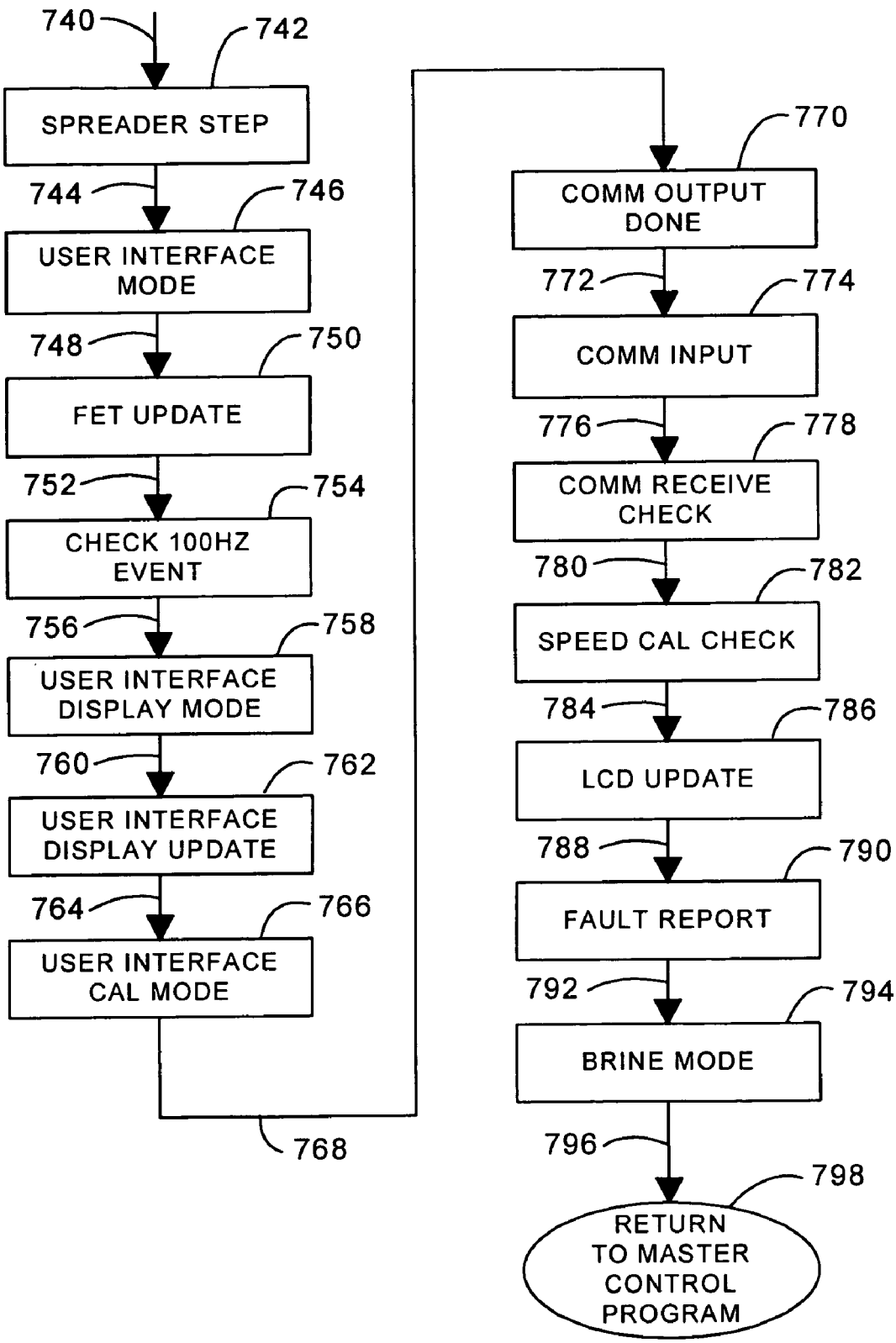

The master control then continues as represented at line 740 which reappears in FIG. 20B extending to the spreader step at block 742. The spreader step involves the following tasks:

(1) Check the operating mode based upon the user interface operating mode event.

(2) Check the spreader switch position and manual key switch position.

(3) Set internal states "spreader active" and "spreader manual".

(4) Set event bits for auger, spinner, wetting to allow update.

(5) Set the pump solid-state switch bit to on or off based on condition of switches.

(6) Spinner can run with the spreader switch off if the spinner-on calibration is set.

(7) Clear solid-state switch bits for auger, spinner, wetting if spreader switch is off.

(8) Also clear pounds per mile, pounds per minute, gallons per mile, gallons per minute registers if spreader is off.

(9) Allow spreader functions in maintenance mode.

(10) Signal solid-state switch event that possible changes are needed.

Line 744 and block 746 look to the user interface mode with the following tasks:

(1) Check to see if RUN/CAL/MAINT switch is in the MAINT position.

(2) If so, set the internal system mode to system maintenance and run an initiation routine to set up some timers and states.

(3) Check to see if RUN/CAL/MAINT switch is in CAL position (4) If so, set the internal system mode to system calibrate and run an initialization routine to setup some timers and states.

(5) If neither key switch position is true and the current mode is CAL or MAINT then save the configuration. Set the system mode to system normal and set distance measuring state to idle.

(6) Set event flags for the following to update: F. plow, W. plow, S. plow, bed control, spreader step, user interface display update.

As represented at line 748 and block 750, the program then looks to the tasks associated with updating the solid-state switches 330. These tasks include:

(1) Check to see if pump is being called for. If so, set it, if not, clear it.

(2) Check to see if bypass is being called for. If so, set it, if not, clear it.

(3) Check to see if data to be written has changed from last data written.

(4) If changed, then check for a fault and write-out the arrays. If no change, then do nothing.

The 100 hz events described in connection with FIG. 19 are then checked wherein calls are made to the following routines:

(1) ADC update (this updates hydraulic pressure and temperature as described in connection with FIG. 9A).

(2) Speed step.

(3) Switch Scan.

(4) User interface timer check.

(5) Scraper timer check.

(6) Fault timer check.

(7) COMM timer check.

(8) Blast timer check.

Next, as represented at line 756 and block 758 the user interface display mode is addressed with the following tasks:

(1) Triggered by change in the mode switch.

(2) Sets an internal LED mode variable based upon the mode switch position.

(3) Sets the event flag Display Update to actually update the display.

The program then looks to the user interface display update as represented at line 760 and block 762. The follow two tasks are considered:

(1) Check for current system mode (MAINT, CAL and NORM)

(2) Depending on the mode a routine is triggered that will update the display.

Next, as represented at line 764 and block 766 a user interface calibration mode will involve the following tasks:

(1) On a bed, plow or blast switch change this event is triggered to check and see if the program is in the calibrate mode. If so the calibration routine is run.

(2) Program checks to see if attempt is made to measure distance (modes 3 or 4). If so, set the event flag to update the display.

The program then continues as represented at line 768 and block 770. The communications output done event is considered with the following tasks:

(1) This event is triggered by the SCI on the output buffer being sent.

(2) Looks at a state machine to determine what to do with respect to: Idle, Dump, Transmit, Receive, Transmit Log, Receive Alert, Transmit Alert, Transmit Configuration, Receive New Configuration, and Debug Read.

Next, as represented at line 772 and block 774 a communications input is considered with the following tasks:

(1) This event is triggered by the SCI on the input buffer having a character in it.

(2) Get the character, check to see what communication state the system is in and run the routine associated with that state. The character is passed into that routine.

As represented at line 776 and block 778 a communication receive check is carried out with the following tasks:

(1) Triggered by the tick event (FIG. 19) if the communication timer has expired.

(2) Check to see which communication state the program is in and run the routine associated with that state.

As represented at line 780 and block 782 a speed calibration check event is provided with the following tasks:

(1) This event is triggered by a change in calibration of the speed constant, analog/digital input, or 2-speed axle change.

(2) Current speed is computed based on the calibration values in units to be used by other modules.

Next, as represented at line 784 and block 786, display 442 is updated with the following tasks:

(1) The display is re-initialized at such time as the vehicle two-way radio us utilized.

(2) The update saves a copy of the current message on the display, re-initializes the display, then reposts the message back onto the display.

Next, as represented at line 788 and block 790, a fault report may be devised in conjunction with the fault timer 690 (FIG. 19). This event includes the following tasks:

(1) It is triggered by the tick event if the fault timer has expired.

(2) Faults are bit mapped as follows:

Fault Internal Bit 0
Spreader Jam Bit 1
High Temperature Bit 2
Spreader Alert Bit 3
Low Fluid Bit 4

Finally, as represented at line 792 and block 794 a brine mode event is entered. This brine mode is that associated with the installation described in connection with FIGS. 2 and 3 above. It involves the following tasks:

(1) It is activated by pressing the Blast button when the Auger, Spinner, and Wetting switches are at zero and the mode is at 2.

(2) Auger, Spinner, Wetting flow rates will then be adjusted based upon a lane selection.

(3) Flow rates are ground oriented based upon a Max Speed of 60 MPH with a max flow of 15 GPM.

The program then returns as represented at line 796 and node 798.

Since certain changes may be made to the above-described system and apparatus without departing from the scope of the invention herein involved, it is intended that all matter contained in the description thereof and shown in the accompanying drawings shall be interpreted as illustrative and not in a limiting sense.

The invention claimed is:

1. A system for controlling the hydraulic actuated components, including snow-ice control components mountable upon a truck having a wheel supported frame, an internal combustion engine, a cab, a support portion configured to receive a load, and a hydraulic pump connected in driven relationship with said engine having a pump output and input, said truck being movable along a roadway at given velocities, comprising:

an operator accessible process controller assembly mounted within said cab having an operator interface portion with a display and one or more manually controllable switch components actuable to provide command inputs to effect control of said hydraulically actuated components, said process controller assembly being connected with a source of electrical power and having a process controller assembly bidirectional data transmission port;

a hermetically secure composite assembly supported from said frame comprising a hydraulic fluid reservoir portion having a fluid level and a suction outlet connectable in fluid transfer relationship with said pump input, further comprising a manifold portion supporting a plurality of electrically actuated hydraulic valves coupled in fluid transfer relationship with said pump output and said hydraulically actuated components and actuateable in response to control inputs, said composite assembly having a composible control assembly including a composite assembly controller responsive to said command inputs to provide composite assembly controller outputs deriving said control inputs to said electrically actuated hydraulic valves, said control assembly being connected with a source of electrical power and said composite assembly controller having a bidirectional transmission port;

a hydraulic return conduiting assembly coupled in fluid flow communication between said composite assembly hydraulic fluid reservoir portion and said hydraulically actuated components; and a bidirectional data transmission bus assembly coupled in command input conveying relationship between said controller assembly bidirectional data transmission port and said composite assembly controller bidirectional transmission port.

2. The system of claim 1 in which:

said composite assembly control assembly includes a driver network responsive to said manifold controller outputs and comprising one or more multi-channel drivers deriving a plurality of driver signals and a plurality of solid-state switches coupled in controlling relationship with said electrically actuated hydraulic valves and responsive to said driver signals to provide said control inputs.

3. The system of claim 1 in which:

a said snow-ice control component is a salt-feed auger coupled in driven relationship with an auger hydraulic motor having an input coupled in hydraulic fluid flow relationship with the output or outputs of one or more auger designated said hydraulic valves and having an output in hydraulic fluid flow relationship with said reservoir portion;

said composite assembly control assembly further comprises a first hydraulic fluid pressure sensor responsive to the hydraulic fluid pressure at said output or outputs of said one or more auger designated hydraulic valves extending to said auger hydraulic motor input to provide a high pressure signal; and a second hydraulic fluid pressure sensor responsive to the hydraulic fluid pressure of the output of said auger hydraulic motor to provide a low pressure signal; and said process controller is generally responsive to the difference between said high pressure signal and said low pressure signal to determine the load experienced at said auger and is configured to provide an operator perceptible cue in response to a determined low auger load condition.

4. The system of claim 1 in which said composite assembly hydraulic fluid reservoir portion comprises:

a reservoir generally having a bottom surface surmounted by one or more vertically upstanding walls extending a fluid reservoir level height;

an elongate fluid receiving chamber comprising side and top portions extending along said bottom surface between a fluid dispensing region and a fluid receiving region;

a fluid return conduit having an input coupled in fluid flow transfer communication with said hydraulic return conduiting assembly and a return fluid outlet extending within said fluid receiving chamber at said fluid receiving region; and an outgasing transfer portion extending through said fluid receiving chamber top portion at said fluid receiving region and effective to transfer gas from fluid expressed from said return fluid outlet outwardly from said fluid receiving region.

5. The system of claim 4 in which:

said fluid receiving chamber is configured with a said suction outlet configured as a suction port extending from said fluid receiving chamber fluid dispensing region through a said upstanding wall.

6. The system of claim 5 in which:

said fluid receiving chamber fluid dispensing region is configured with one or more inlet ports in fluid flow communication between said fluid dispensing region and hydraulic fluid within said reservoir located without said fluid receiving chamber.

7. The system of claim 4 in which said fluid receiving chamber further comprises a fluid baffle extending generally from said bottom surface upwardly to a baffle top spaced from said fluid receiving chamber top portion, said fluid baffle being located intermediate said fluid dispensing region and said fluid receiving region.

8. The system of claim 7 in which:

said baffle is slanted toward said fluid dispensing region to an extent effective to promote movement of hydraulic fluid expressed from said return fluid outlet toward the vicinity of said outgasing transfer portion.

9. The system of claim 4 in which:

said return fluid outlet extending within said fluid receiving chamber is configured to promote the movement of hydraulic fluid expressed therefrom toward the vicinity of said outgasing transfer portion.

10. The system of claim 9 in which:

said return fluid outlet is configured as a conduit opening which is upwardly slanting toward the vicinity of said outgasing transfer portion.

11. The system of claim 4 in which:

said outgoing transfer portion is configured as one or more apertures.

12. The system of claim 1 in which said hermetically secure composite assembly further comprises a pressure establishing valve located above said fluid level and configured to maintain a positive gas pressure within said composite assembly.

13. The system of claim 1 in which in which said hermetically secure composite assembly further comprises:

a hydraulic fluid filler port located above said hydraulic fluid reservoir portion fluid level; and a pressurizing filler breather cap removably coupled upon said hydraulic fluid filler port and configured to maintain a positive gas pressure within said composite assembly.

14. The system of claim 1 in which:

said manifold portion and said control assembly of said composite assembly are located above said hydraulic fluid reservoir portion.

15. The system of claim 1 in which:

said bidirectional data transmission bus is a Recommended Standard 485 bus.

16. The system of claim 1 in which:

a snow-ice control component is a salt feed auger coupled in driven relationship with an auger hydraulic motor having an input coupled in hydraulic fluid flow driven relationship with an auger designated array of three or more said electrically actuated hydraulic valves hydraulically coupled from first to last with a common hydraulic array input and a respective binary succession of hydraulic flow rate outputs coupled in common with said auger hydraulic motor input; and said process controller assembly provides said command inputs to derive said control inputs to said auger designated array of electrically actuated valves in correspondence with said given velocities.

17. The system of claim 1 in which:

a snow-ice control component is a snow-ice control liquid pump coupled in driven relationship with a pump hydraulic motor having an input coupled in hydraulic fluid flow driven relationship with a pump designated array of three or more said electrically actuated hydraulic valves hydraulically coupled from first to last with a common hydraulic array input and a respective binary succession of hydraulic flow rate outputs coupled in common with said pump motor input; and said process controller assembly provides said command inputs to derive said control inputs to said pump designated array of electrically actuated valves in correspondence with said given velocities.

18. A system for controlling the hydraulically actuated components, including snow-ice control components, mountable upon a truck having a wheel supported frame, an engine, a cab, a support portion configured to receive a load, and a hydraulic pump connected in driven relationship with said engine having a pump output and input, said truck being movable along a roadway at given velocities, comprising:

an operator accessible controller assembly mounted within said cab, having an operator interface portion with a display responsive to a display input to provide a visibly perceptible output and one or more switch components manually actuateable to provide switch conditions, and having an operator interface controller operationally coupled with said display and responsive to receive switch data corresponding with said switch conditions, said operator interface controller having a bidirectional data transmission port for receiving command inputs effecting the derivation of said display input and for receiving interrogate inputs to effect transmission of said switch data;

a hermetically secure composite assembly supported from said frame, comprising a hydraulic fluid reservoir portion having a fluid level and a suction outlet connectable in fluid transfer relationship with said pump input, further comprising a manifold portion supporting a plurality of electrically actuated hydraulic valves coupled in fluid transfer relationship with said pump output and said hydraulically actuated components and actuateable in response to control inputs, said composite assembly having a composite control assembly including a composite assembly controller operationally coupled with said electrically actuated hydraulic valves, said composite assembly controller having a bidirectional data transmission port for receiving command inputs and is responsive thereto to provide composite assembly controller outputs effecting the derivation of said control inputs, and said bidirectional data transmission port is configured for receiving interrogate inputs to effect transmission of valve data corresponding with the state of actuation of said electrically actuated hydraulic valves;

a master controller located in said cab, having a bidirectional data transmission port and providing said command inputs and interrogate inputs at its said data transmission port;

a bidirectional data transmission assembly interconnecting said bidirectional data transmission ports of said master controller, said interface controller and said composite assembly controller in bidirectional data transfer relationship; and a hydraulic return conduiting assembly coupled in fluid flow communication between said composite assembly hydraulic fluid reservoir portion and said hydraulically actuated components.

19. The system of claim 18 in which:

said composite control assembly includes a driver network responsive to said composite assembly controller outputs and comprising one or more multi-channel drivers deriving a plurality of driver signals and a plurality of solid-state switches coupled in controlling relationship with said electrically actuated hydraulic valves and responsive to said driver signals to provide said control inputs.

20. The system of claim 19 in which:

said composite control assembly further comprises:

a source of power;

a relay assembly coupled in switching relationship between said source of power and said solid-state switches and actuateable to terminate the application of power thereto; and a microprocessor supervisory circuit responsive in the absence said composite controller outputs to said driver network for an interval of time to effect said actuation of said relay assembly.

21. The system of claim 19 in which:

said composite control assembly further comprises:

a source of power;

an electronics power supply having a given voltage level;

a relay assembly coupled in switching relationship between said source of power and said solid-state switches and actuateable to terminate the application of power thereto; and a microprocessor supervisory circuit responsive to said given voltage level dropping to a low value to effect actuation of said relay assembly.

22. The system of claim 19 in which:

said driver network comprises one or more multi-channel low voltage serial to high voltage parallel converters.

23. The system of claim 18 in which:

said master controller is mounted with said operator accessible controller assembly.

24. The system of claim 18 in which:

said composite control assembly further comprises a low hydraulic fluid level sensor mounted for response to said reservoir portion fluid level, operationally coupled with said composite assembly controller and responsive in the presence of a low level condition of hydraulic fluid to provide a low fluid output to said composite assembly controller deriving a low fluid condition datum thereat;

said composite assembly controller providing said low fluid condition datum to said composite assembly controller data transmission port in response to a said interrogation input; and said master controller is responsive to a said low fluid datum conveyed thereto by said bidirectional data transmission assembly to provide a said command input to said operator interface controller bidirectional data transmission port deriving a said display input effecting a said visibly perceptible output as a low hydraulic fluid level cue.

25. The system of claim 24 in which:

said operator accessible controller assembly further comprises an annunciator operationally coupled with said operator interface controller and responsive to an annunciator signal to provide an aurally perceptible output; and said master controller is responsive to a said low fluid datum conveyed thereto by said bidirectional data transmission assembly to provide a command input to said operator interface controller bidirectional data transmission port deriving a said annunciator signal as a low hydraulic fluid level cue.

26. The system of claim 18 in which:

said composite control assembly further comprises a temperature sensor having a temperature output corresponding with the temperature of hydraulic fluid at said reservoir portion;

said composite assembly controller is responsive to said temperature output to provide temperature data corresponding thereto at said composite assembly controller data transmission port in response to a said interrogation input; and said master controller is responsive to said temperature data conveyed thereto by said bidirectional data transmission assembly to provide one or more command inputs to said composite assembly controller effecting said derivation of one or more said control inputs in correspondence with said temperature data.

27. The system of claim 26 in which:

said master controller is responsive to said temperature data when representing an excessive hydraulic fluid temperature to provide a command input to said operator interface controller bidirectional data transmission port deriving a said display input effecting a said visibly perceptible output as an excessive temperature hydraulic fluid cue.

28. The system of claim 26 in which:

said master controller is responsive to said temperature data when representing an excessive hydraulic fluid temperature to provide a command input to said composite assembly controller effecting termination of said control inputs.

29. The system of claim 18 in which:

a said snow-ice control component is a salt feed auger coupled in driven relationship with an auger hydraulic motor having an input coupled in hydraulic fluid flow relationship with the output or outputs of one or more auger designated said hydraulic valves each having an output in fluid flow relationship with said reservoir portion;

said composite control assembly further comprises a first hydraulic fluid pressure sensor responsive to the hydraulic fluid pressure at said output or outputs of said one or more auger designated hydraulic valves extending to said auger hydraulic motor input to provide high pressure signals, and a second hydraulic fluid pressure sensor responsive to the hydraulic fluid pressure of the output of said auger hydraulic motor to provide a low pressure signal;

said composite assembly controller is responsive to a said interrogate input to acquire said high pressure signal and said low pressure signal as pressure data and provide said pressure data to said data transmission port thereof for conveyance along said bidirectional data transmission assembly to said master controller; and said master controller is responsive to said pressure data to derive and evaluate auger motor load values.

30. The system of claim 29 in which:

said master controller is responsive in the presence of a said auger motor load representing a low granular salt supply to provide a said command input to said operator interface controller bidirectional data transmission port deriving a said display input effecting a said visibly perceptible output as a low salt supply cue.

31. The system of claim 18 in which:

said composite control assembly further comprises a filter circuit responsive to a sequence of speed data bits corresponding with said given vehicle velocities to derive filtered speed data bits;

said composite assembly controller is responsive to said filtered speed data bits to provide vehicle velocity data to said composite assembly controller data transmission port in response to a said interrogation input; and said master controller is responsive to said vehicle velocity data to derive command inputs corresponding therewith to said composite assembly controller to provide said control inputs to said electrically actuated hydraulic valves.

32. The system of claim 31 in which:

said composite control assembly further comprises a signal treatment circuit response to a two-speed input condition corresponding with a transmission range of said truck to derive a treated two-speed datum;

said composite assembly controller is responsive to said filtered speed data bits and said two-speed datum to provide vehicle velocity data to said composite assembly controller data transmission port in response to a said interrogation input; and said master controller is responsive to said vehicle velocity data and said two-speed datum to provide command inputs corresponding therewith to said composite assembly controller to derive said control inputs to said electrically actuated hydraulic valves.

33. The system of claim 18 further comprising:

a datalog and communications controller assembly located within said cab, having a communications controller operationally coupled with a memory and one or more serial interface ports configured to receive data for submittal to said memory and having a bidirectional data transmission port coupled with said bidirectional transmission assembly and configured to receive a said command input to effect submittal of said data to memory.

34. The system of claim 33 in which:

a said snow-ice control component is a plow with a plow position sensor having a position condition;

said composite control assembly further comprises a plow position signal treatment assembly responsive to said position condition to provide a treated plow position condition;

said composite assembly controller is responsive to a said interrogation input to provide plow position data to said composite assembly controller data transmission port; and said master controller is responsive to said plow position data to provide a said command input to said datalog and communications controller effecting the submittal of said plow position data to said memory.

35. The system of claim 33 in which:

said composite control assembly further comprises a filter circuit responsive to a sequence of speed data bits corresponding with said given vehicle velocities to derive filtered speed data bits;

said composite assembly controller is responsive to said filtered speed data bits to provide vehicle velocity data to said composite assembly controller data transmission port in response to a said interrogation input; and said master controller is responsive to said vehicle velocity data to provide a said command input to said datalog and communications controller effecting the submittal of said vehicle velocity data to said memory.

36. The system of claim 18 in which:

said composite control assembly further comprises a low hydraulic fluid level sensor mounted for response to the hydraulic fluid level at said reservoir portion, operationally coupled with said composite assembly controller and responsive in the presence of a low level condition of hydraulic fluid to provide a low fluid output to said composite assembly controller deriving a low fluid condition datum thereat;

said composite assembly controller providing said low fluid condition datum to said composite assembly controller data transmission port in response to a said interrogation input; and said master controller is responsive to a said low fluid datum conveyed thereto by said bidirectional data transmission assembly to provide a said command input to said operator interface controller bidirectional data transmission port deriving a said display input effecting a said visibly perceptible output as a low hydraulic fluid level cue.

37. A system for controlling the hydraulically actuated components of a truck, including snow-ice components mountable upon said truck, said truck having a wheel supported frame, an engine, a cab, a dump bed configured to receive a load, and a hydraulic pump coupled in driven relationship with said engine having a pump output and input, said truck being movable along a roadway at given velocities, comprising:

An operator accessible controller assembly mounted within said cab, having an operator interface portion with a display responsive to a display input to provide a visibly perceptible output and one or more switch components manually actuateable to provide switch conditions, and having an operator interface controller operationally coupled with said display and responsive to receive switch data corresponding with said switch conditions, said operator interface controller having a bidirectional data transmission port configured to receive command inputs effecting the derivation of said display input, and for receiving interrogate inputs to effect transmission of said switch data;

A hermetically secure composite assembly supported from said frame, having a hydraulic reservoir fluid portion comprising a reservoir generally having a bottom surface surmounted by one or more upstanding walls extending a fluid reservoir height, an elongate fluid receiving chamber comprising side and top portions extending along said bottom surface between a fluid dispensing region and a fluid receiving region, a fluid return conduit configured to receive return hydraulic fluid from said hydraulically actuated components and convey said return hydraulic fluid through a return fluid outlet extending within said fluid receiving chamber at said fluid receiving region, and an outgasing transfer portion extending through said fluid receiving chamber top portion of said fluid receiving region and effective to transfer gas from fluid expressed from said return fluid outlet outwardly from said fluid receiving region, a suction outlet in fluid transfer relationship with said fluid dispensing region and connectable in fluid transfer relationship with said pump input, said composite assembly further comprising a manifold portion supporting a plurality of electrically actuated hydraulic valves coupled in fluid transfer relationship with said pump output and said hydraulically actuated components and actuateable in response to control inputs, said composite assembly further comprising a composite control assembly including a composite assembly controller operationally coupled with said electrically actuated hydraulic valves and having a bidirectional data transmission port configured to receive command inputs and responsive thereto to provide composite assembly controller outputs effecting the derivation said of control inputs, said bidirectional data port being configured for receiving interrogate inputs to effect transmission of valve data corresponding with the state of actuation of said electrically actuated hydraulic valves;

a master controller located in said cab, having a bidirectional data transmission port and providing said command inputs and interrogate inputs at its said data transmission port; and a bidirectional data transmission assembly interconnecting said bidirectional data transmission ports of said master controller, said interface controller and said composite assembly controller in bidirectional data transfer relationship.

38. The system of claim 37 in which:

said composite control assembly includes a driver network responsive to said composite assembly controller outputs and comprising one or more multi-channel drivers deriving a plurality of driver signals and a plurality of solid-state switches coupled in controlling relationship with said electrically actuated hydraulic valves and responsive to said driver signals to provide said control inputs.

39. The system of claim 38 in which:

said composite control assembly further comprises:

a source of power;

a relay assembly coupled in switching relationship between said source of power and said solid-state switches and actuateable to terminate the application of power thereto; and a microprocessor supervisory circuit responsive in the absence said composite controller outputs to said driver network for an interval of time to effect said actuation of said relay assembly.

40. The system of claim 38 in which:

said composite control assembly further comprises:

a source of power;

an electronics power supply having a given voltage level;

a relay assembly coupled in switching relationship between said source of power and said solid-state switches and actuateable to terminate the application of power thereto; and a microprocessor supervisory circuit responsive to said given voltage level dropping to a low value to effect actuation of said relay assembly.

41. The system of claim 37 in which:

said composite control assembly further comprises a temperature sensor having a temperature output corresponding with the temperature of hydraulic fluid at said reservoir portion;

said composite assembly controller is responsive to said temperature output to provide temperature data corresponding thereto at said composite assembly controller data transmission port in response to a said interrogation input; and said master controller is responsive to said temperature data conveyed thereto by said bidirectional data transmission assembly to provide one or more command inputs to said composite assembly controller effecting said derivation of one or more said control inputs in correspondence with said temperature data.

42. The system of claim 37 in which:

a said snow-ice control component is a salt feed auger coupled in driven relationship with an auger hydraulic motor having an input coupled in hydraulic fluid flow relationship with the output or outputs of one or more auger designated said hydraulic valves each having an output in fluid flow relationship with said reservoir portion;

said composite control assembly further comprises a first hydraulic fluid pressure sensor responsive to the hydraulic fluid pressure at said output or outputs of said one or more auger designated hydraulic valves extending to said auger hydraulic motor input to provide high pressure signals, and a second hydraulic fluid pressure sensor responsive to the hydraulic fluid pressure of the output of said auger hydraulic motor to provide a low pressure signal;

said composite assembly controller is responsive to a said interrogate input to acquire said high pressure signal and said low pressure signal as pressure data and provide said pressure data to said data transmission port thereof for conveyance along said bidirectional data transmission assembly to said master controller; and said master controller is responsive to said pressure data to derive and evaluate auger motor load values.

43. The system of claim 42 in which:

said master controller is responsive in the presence of a said auger motor load representing a low granular salt supply to provide a said command input to said operator interface controller bidirectional data transmission port deriving a said display input effecting a said visibly perceptible output as a low salt supply cue.

44. The system of claim 37 in which:

said fluid receiving chamber is configured with a said suction outlet configured as a suction port extending from said fluid receiving chamber fluid dispensing region through a said upstanding wall.

45. The system of claim 44 in which:

said fluid receiving chamber fluid dispensing region is configured with one or more inlet ports in fluid flow communication between said fluid dispensing region and hydraulic fluid within said reservoir located without and remote from said fluid receiving chamber.

46. The system of claim 37 in which said fluid receiving chamber further comprises a fluid baffle extending generally from said bottom surface upwardly to a baffle top spaced from said fluid receiving chamber top portion, said fluid baffle being located intermediate said fluid dispensing region and said fluid receiving region.

47. The system of claim 46 in which:

said baffle is slanted toward said fluid dispensing region to an extent effective to promote movement of hydraulic fluid expressed from said return fluid outlet toward the vicinity of said outgasing transfer portion.

48. The system of claim 37 in which:

said return fluid outlet extending within said fluid receiving chamber is configured to promote the movement of hydraulic fluid expressed therefrom toward the vicinity of said outgasing transfer portion.

* * * * *